US011468870B2

(12) United States Patent
Danjyo et al.

(10) Patent No.: US 11,468,870 B2
(45) Date of Patent: Oct. 11, 2022

(54) ELECTRONIC MUSICAL INSTRUMENT, ELECTRONIC MUSICAL INSTRUMENT CONTROL METHOD, AND STORAGE MEDIUM

(71) Applicant: CASIO COMPUTER CO., LTD., Tokyo (JP)

(72) Inventors: Makoto Danjyo, Saitama (JP); Fumiaki Ota, Tokyo (JP); Masaru Setoguchi, Tokyo (JP); Atsushi Nakamura, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 192 days.

(21) Appl. No.: 17/036,500

(22) Filed: Sep. 29, 2020

(65) Prior Publication Data

US 2021/0012758 A1 Jan. 14, 2021

Related U.S. Application Data

(63) Continuation of application No. 16/447,572, filed on Jun. 20, 2019, now Pat. No. 10,825,433.

(30) Foreign Application Priority Data

Jun. 21, 2018 (JP) ..... JP2018-118055

(51) Int. Cl.
*G10H 1/00* (2006.01)
*G10H 7/00* (2006.01)

(52) U.S. Cl.
CPC ..... *G10H 1/0008* (2013.01); *G10H 7/004* (2013.01); *G10H 7/008* (2013.01);
(Continued)

(58) Field of Classification Search
CPC ..... G10H 1/0008; G10H 7/004; G10H 7/008; G10H 2210/121; G10H 2210/165;
(Continued)

(56) References Cited

U.S. PATENT DOCUMENTS 5,621,182 A * 4/1997 Matsumoto ..... G10H 1/366 84/610
5,703,311 A * 12/1997 Ohta ..... G10H 7/10 84/622
(Continued)

FOREIGN PATENT DOCUMENTS

EP 2270773 A1 1/2011
EP 2930714 A1 * 10/2015 ..... G10H 1/0066
(Continued)

OTHER PUBLICATIONS

U.S. Appl. No. 17/036,582, filed Sep. 29, 2020.
(Continued)

*Primary Examiner* — Christina M Schreiber
(74) *Attorney, Agent, or Firm* — Chen Yoshimura LLP

(57) ABSTRACT

An electronic musical instrument includes: a memory that stores lyric data including lyrics for a plurality of timings, pitch data including pitches for said plurality of timings, and a trained model that has been trained and learned singing voice features of a singer; and at least one processor, wherein at each of said plurality of timings, the at least one processor: if the operation unit is not operated, obtains, from the trained model, a singing voice feature associated with a lyric indicated by the lyric data and a pitch indicated by the pitch data; if the operation unit is operated, obtains, from the trained model, a singing voice feature associated with the lyric indicated by the lyric data and a pitch indicated by the
(Continued)

operation of the operation unit; and synthesizes and outputs singing voice data based on the obtained singing voice feature of the singer.

17 Claims, 11 Drawing Sheets

(52) U.S. Cl.
CPC . *G10H 2210/121* (2013.01); *G10H 2210/165* (2013.01); *G10H 2210/191* (2013.01); *G10H 2210/201* (2013.01); *G10H 2210/231* (2013.01); *G10H 2220/221* (2013.01); *G10H 2230/025* (2013.01); *G10H 2250/015* (2013.01); *G10H 2250/311* (2013.01); *G10H 2250/455* (2013.01)

(58) Field of Classification Search
CPC ..... G10H 2210/191; G10H 2210/201; G10H 2210/231; G10H 2220/221; G10H 2230/025; G10H 2250/015; G10H 2250/311; G10H 2250/455
USPC ..... 84/602
See application file for complete search history.

(56) References Cited

U.S. PATENT DOCUMENTS 5,747,715 A * 5/1998 Ohta ..... G10H 1/36 84/622
5,750,912 A * 5/1998 Matsumoto ..... G10L 21/00 704/E21.001
5,889,223 A * 3/1999 Matsumoto ..... G10H 1/366 84/622
6,337,433 B1 * 1/2002 Nishimoto ..... A63J 17/00 84/478
6,369,311 B1 * 4/2002 Iwamoto ..... G10H 1/38 84/615
8,008,563 B1 * 8/2011 Hastings ..... G09B 15/08 84/479 A
10,325,581 B2 * 6/2019 Ogasawara ..... G10H 1/0008
2002/0005111 A1 * 1/2002 Ludwig ..... G10H 1/00 84/645
2002/0017187 A1 * 2/2002 Takahashi ..... G09B 15/023 84/478
2003/0009344 A1 * 1/2003 Kayama ..... G10L 13/02 704/500
2004/0040434 A1 * 3/2004 Kondo ..... G10H 1/0008 84/604
2005/0137862 A1 * 6/2005 Monkowski ..... G10L 15/06 704/E15.007
2005/0257667 A1 * 11/2005 Nakamura ..... G10L 13/033 704/E13.004
2006/0015344 A1 * 1/2006 Kemmochi ..... G10L 13/06 704/267
2006/0111908 A1 * 5/2006 Sakata ..... G10L 13/033 704/258
2006/0173676 A1 * 8/2006 Kemmochi ..... G10L 13/06 704/207
2009/0306987 A1 * 12/2009 Nakano ..... G10H 1/366 704/E13.011
2009/0307207 A1 * 12/2009 Murray ..... G11B 27/105 707/999.005
2011/0000360 A1 * 1/2011 Saino ..... G10L 13/10 84/622
2014/0006031 A1 * 1/2014 Mizuguchi ..... G10H 7/02 704/260
2016/0111083 A1 * 4/2016 Iriyama ..... G10H 1/0066 704/267
2017/0025115 A1 * 1/2017 Tachibana ..... G10L 13/0335
2017/0140745 A1 * 5/2017 Nayak ..... G10H 1/366
2018/0018949 A1 * 1/2018 Sullivan ..... G10H 1/366
2018/0277075 A1 * 9/2018 Nakamura ..... G10H 1/0008
2018/0277077 A1 * 9/2018 Nakamura ..... G10H 1/0016
2018/0277080 A1 * 9/2018 Nakamura ..... G10H 1/34
2019/0096372 A1 * 3/2019 Setoguchi ..... G10H 1/06
2019/0096373 A1 * 3/2019 Setoguchi ..... G10H 1/344
2019/0096379 A1 * 3/2019 Iwase ..... G10H 7/04
2019/0198001 A1 * 6/2019 Danjyo ..... G10C 3/12
2019/0304327 A1 * 10/2019 Setoguchi ..... G09B 19/00
2019/0318712 A1 * 10/2019 Nakamura ..... G10H 1/0033
2019/0318715 A1 * 10/2019 Danjyo ..... G10H 1/366
2019/0392798 A1 * 12/2019 Danjyo ..... G10H 1/366
2019/0392799 A1 * 12/2019 Danjyo ..... G10H 7/008
2019/0392807 A1 * 12/2019 Danjyo ..... G10H 1/125
2020/0294485 A1 * 9/2020 Tachibana ..... G10L 13/00
2021/0012758 A1 * 1/2021 Danjyo ..... G10H 1/0008
2021/0193114 A1 * 6/2021 Danjyo ..... G10L 13/02
2021/0295819 A1 * 9/2021 Danjyo ..... G10L 13/04
2022/0076651 A1 * 3/2022 Danjyo ..... G10H 1/0008
2022/0076658 A1 * 3/2022 Danjyo ..... G10H 1/34

FOREIGN PATENT DOCUMENTS

EP 2930714 A1 10/2015
EP 3159892 A1 * 4/2017 ..... G10G 1/00
EP 3159892 A1 4/2017
JP H04-238384 A 8/1992
JP H06-322449 A 12/1994
JP H09-050287 A 2/1997
JP 2001-67078 A 3/2001
JP 2004-86067 A 3/2004
JP 2005-331806 A 12/2005
JP 2006-146095 A 6/2006
JP 2011-013454 A 1/2011
JP 2013-231872 A 11/2013
JP 2014-10190 A 1/2014
JP 2014-62969 A 4/2014
JP 2016-206323 A 12/2016
JP 2017-27021 A 2/2017
JP 2017-97176 A 6/2017
JP 2017-107228 A 6/2017
JP 2017107228 A * 6/2017
JP 2017-194594 A 10/2017

OTHER PUBLICATIONS

Kei Hashimoto and Shinji Takaki, "Statistical parametric speech synthesis based on deep learning", Journal of the Acoustical Society of Japan, vol. 73, No. 1 (2017), pp. 55-62 (Cited in the parent U.S. Appl. No. 16/447,572 and mentioned in paragraph Nos. 22-23, 35, 51, 65, 74, and 79 of the application as a concise explanation of relevance.).
Shinji Sako, Keijiro Saino, Yoshihiko Nankaku, Keiichi Tokuda, and Tadashi Kitamura, "A trainable singing voice synthesis system capable of representing personal characteristics and singing styles", Information Processing Society of Japan (IPSJ) Technical Report, Music and Computer (MUS) 2008 (12 (2008-MUS-074)), pp. 39-44, Feb. 8, 2008 (Cited in the parent U.S. Appl. No. 16/447,572 and mentioned in paragraph Nos. 51-52, 54, 65, 74, and 79 of the application and English abstract included as a concise explanation of relevance.).
U.S. Appl. No. 16/447,586, filed Jun. 20, 2019.
U.S. Appl. No. 16/447,630, filed Jun. 20, 2019.
U.S. Appl. No. 16/384,861, filed Apr. 15, 2019.
U.S. Appl. No. 16/384,883, filed Apr. 15, 2019.
Japanese Office Action dated May 28, 2019, in a counterpart Japanese patent application No. 2018-078110. (Cited in the parent U.S. Appl. No. 16/447,572 and a machine translation (not reviewed for accuracy) attached.).
Japanese Office Action dated May 28, 2019, in a counterpart Japanese patent application No. 2018-078113. (Cited in the parent U.S. Appl. No. 16/447,572 and a machine translation (not reviewed for accuracy) attached.).
U.S. Appl. No. 16/814,374, filed Mar. 10, 2020.
European Search Report dated Oct. 29, 2019, in a counterpart European patent application No. 19181429.2. (Cited in the parent U.S. Appl. No. 16/447,572).

(56) References Cited

OTHER PUBLICATIONS

European Search Report dated Oct. 29, 2019, in a counterpart European patent application No. 19181426.8. (Cited in the parent U.S. Appl. No. 16/447,572).
Merlijn Blaauw et al., "A Neural Parametric Singing Synthesizer Modeling Timbre and Expression from Natural Songs", Applied Sciences, vol. 7, No. 12, Dec. 18, 2017 (Dec. 18, 2017), p. 1313, XP055627719 (Cited in the parent U.S. Appl. No. 16/447,572).
Masanari Nishimura et al., "Singing Voice Synthesis Based on Deep Neural Networks", INTERSPEECH 2016, vol. 2016, Sep. 8, 2016 (Sep. 8, 2016), pp. 2478-2482, XP055627666 (Cited in the parent U.S. Appl. No. 16/447,572).
Japanese Office Action dated May 28, 2019, in a counterpart Japanese patent application No. 2018-118056. (Cited in the parent U.S. Appl. No. 16/447,572 and a machine translation (not reviewed for accuracy) attached.).
Japanese Office Action dated May 28, 2019, in a counterpart Japanese patent application No. 2018-118055. (Cited in the parent U.S. Appl. No. 16/447,572 and a machine translation (not reviewed for accuracy) attached.).
Office Action dated Dec. 9, 2021 in U.S. Appl. No. 16/814,373, which has been cross-referenced to the instant application. U.S. Patent Publication documents 1-2 listed above and Non-Patent Literature document No. 2 below were cited in that Office Action.
Tim Beamish et al. (T. Beamish, K. Maclean and S. Feis, "Designing the haptic turntable for musical control," 11th Symposium on Haptic Interfaces for Virtual Environment and Teleoperator Systems, 2003. HAPTICS 2003 Proceedings., 2003, pp. 24-31, doi:10.11 09/HAPTIC.2003.1191221.) (Year: 2003).

* cited by examiner

| | | | |
|---|---|---|---|
| Header chunk | | ChunkID | Fixed string "MThd"=0x4d546864 |
| | | ChunkSize | Length of header chunk =0x00000006 |
| | | FormatType | Format: e.g., 0x0001 |
| | | NumberOfTrack | Number of tracks: e.g., 0x0002 |
| | | TimeDivision | Timebase: e.g., 0x1e0 |
| First track chunk (lyric part) | | ChunkID | Fixed string "MTrk"=0x4d54726b |
| | | ChunkSize_1 | Length of first track chunk |
| | DeltaTime_1[0] | DeltaTime | Wait time since last event |
| | Event_1[0] | Event | Event |
| | DeltaTime_1[1] | DeltaTime | Wait time since last event |
| | Event_1[1] | Event | Event |
| | . . . | . . . | |
| | DeltaTime_1[L-1] | DeltaTime | Wait time since last event |
| | Event_1[L-1] | Event | Must have "End of Track" at end of track |
| Second track chunk (accompaniment part) | | ChunkID | Fixed string "MTrk"=0x4d54726b |
| | | ChunkSize_2 | Length of second track chunk |
| | DeltaTime_2[0] | DeltaTime | Wait time since last event |
| | Event_2[0] | Event | Event |
| | DeltaTime_2[1] | DeltaTime | Wait time since last event |
| | Event_2[1] | Event | Event |
| | . . . | . . . | |
| | DeltaTime_2[M-1] | DeltaTime | Wait time since last event |
| | Event_2[M-1] | Event | Must have "End of Track" at end of track |

FIG. 6

ELECTRONIC MUSICAL INSTRUMENT, ELECTRONIC MUSICAL INSTRUMENT CONTROL METHOD, AND STORAGE MEDIUM

BACKGROUND OF THE INVENTION

Technical Field

The present invention relates to an electronic musical instrument that generates a singing voice in accordance with the operation of an operation element on a keyboard or the like, an electronic musical instrument control method, and a storage medium.

Background Art

Hitherto known electronic musical instruments output a singing voice that is synthesized using concatenative synthesis, in which fragments of recorded speech are connected together and processed (for example, see Patent Document 1).

RELATED ART DOCUMENTS

Patent Documents

Patent Document 1: Japanese Patent Application Laid-Open Publication No. H09-050287

SUMMARY OF THE INVENTION

However, this method, which can be considered an extension of pulse code modulation (PCM), requires long hours of recording when being developed. Complex calculations for smoothly joining fragments of recorded speech together and adjustments so as to provide a natural-sounding singing voice are also required with this method.

Additional or separate features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, in one aspect, the present disclosure provides an electronic musical instrument including: a plurality of operation elements respectively corresponding to mutually different pitch data; a memory that stores a trained acoustic model obtained by performing machine learning on training musical score data including training lyric data and training pitch data, and on training singing voice data of a singer corresponding to the training musical score data, the trained acoustic model being configured to receive lyric data and pitch data and output acoustic feature data of a singing voice of the singer in response to the received lyric data and pitch data; and at least one processor, wherein the at least one processor: in accordance with a user operation on an operation element in the plurality of operation elements, inputs prescribed lyric data and pitch data corresponding to the user operation of the operation element to the trained acoustic model so as to cause the trained acoustic model to output the acoustic feature data in response to the inputted prescribed lyric data and the inputted pitch data, and digitally synthesizes and outputs inferred singing voice data that infers a singing voice of the singer on the basis of the acoustic feature data output by the trained acoustic model in response to the inputted prescribed lyric data and the inputted pitch data.

In another aspect, the present disclosure provides an electronic musical instrument including: an operation unit that specifies a pitch; a memory that stores lyric data including lyrics for a plurality of timings, pitch data including pitches for said plurality of timings, and a trained model that has been trained and learned singing voice features of a singer based on training data including lyrics and pitches; and at least one processor, wherein at each of said plurality of timings, the at least one processor performs the following: if the operation unit is not operated at the timing, obtaining, from the trained model, a singing voice feature of the singer that is associated with a lyric indicated by the lyric data for the timing and a pitch indicated by the pitch data for the timing; if the operation unit is operated at the timing, obtaining, from the trained model, a singing voice feature of the singer that is associated with the lyric indicated by the lyric data for the timing and a pitch indicated by the operation of the operation unit at the timing; and synthesizing and outputting singing voice data based on the obtained singing voice feature of the singer.

In another aspect, the present disclosure provides an electronic musical instrument, including: an operation unit that receives a user operation; a memory that stores a trained model that has been trained and learned singing voice features of a singer based on training data including lyrics and pitches; and at least one processor, wherein the at least one processor performs the following: in response to a first operation of the operation unit, obtaining, from the trained model, a singing voice feature of the singer that is associated with a lyric and a pitch indicated by the first operation of the operation unit; synthesizing and outputting singing voice data based on the obtained singing voice feature of the singer; and if a second operation of the operation unit is performed during the first operation of the operation unit, applying an acoustic effect on the singing voice data.

In another aspect, the present disclosure provides a method performed by the at least one processor in the electronic musical instrument of any of the aspects described above, the method including, via the at least one processor, each step performed by the at least one processor described above.

In another aspect, the present disclosure provides a non-transitory computer-readable storage medium having stored thereon a program executable by the at least one processor in the above-described electronic musical instrument, the program causing the at least one processor to perform each step performed by the at least one processor described above.

An aspect of the present invention produces a singing voice of a singer that has been inferred by a trained acoustic model, and thus long hours of recording singing voices, which may span dozens of hours, are not necessary for development. Further, complex calculations for smoothly joining fragments of recorded speech together and adjustments so as to provide a natural-sounding singing voice are not necessary to produce sound.

It is to be understood that both the foregoing general description and the following detailed description are exemplary and explanatory, and are intended to provide further explanation of the invention as claimed.

BRIEF DESCRIPTION OF THE DRAWINGS

FIG. 6 is a diagram illustrating an example data configuration in the embodiments.

DETAILED DESCRIPTION OF EMBODIMENTS

Embodiments of the present invention will be described in detail below with reference to the drawings.

Figure 1:
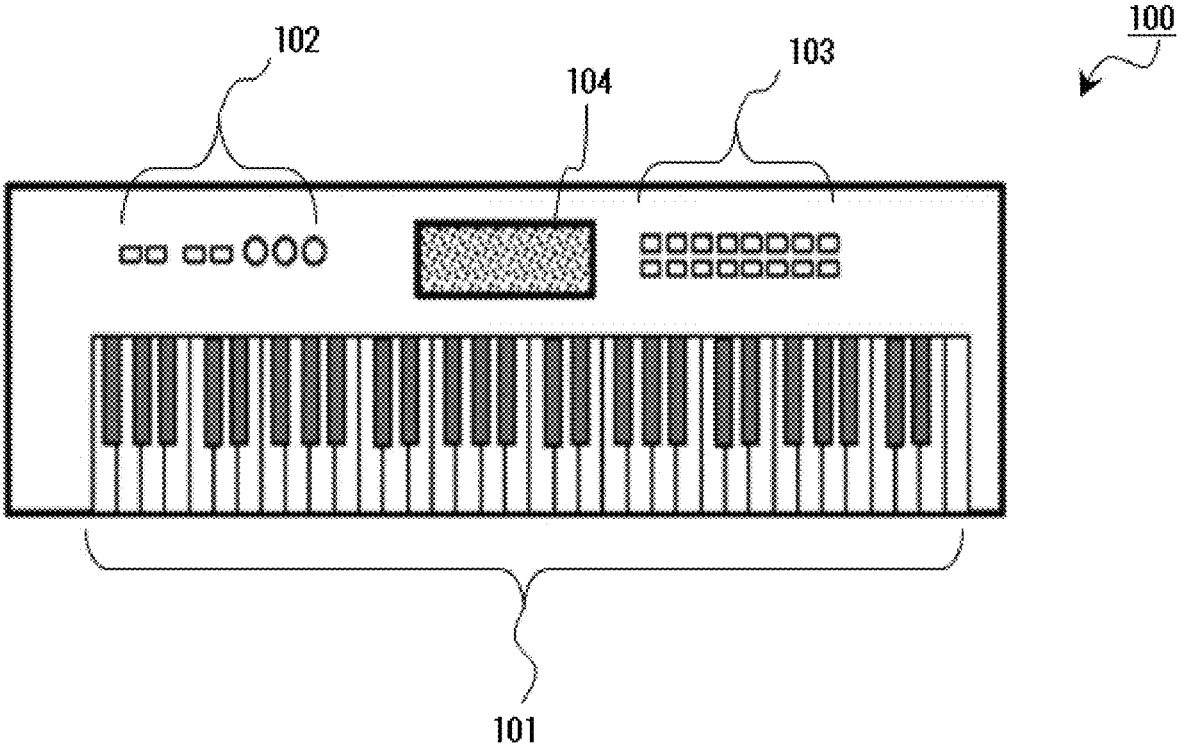
FIG. 1 is a diagram illustrating an example external view of an embodiment of an electronic keyboard instrument of the present invention.

FIG. 1 is a diagram illustrating an example external view of an embodiment of an electronic keyboard instrument 100 of the present invention. The electronic keyboard instrument 100 is provided with, inter alia, a keyboard 101, a first switch panel 102, a second switch panel 103, and a liquid crystal display (LCD) 104. The keyboard 101 is made up of a plurality of keys serving as performance operation elements. The first switch panel 102 is used to specify various settings, such as specifying volume, setting a tempo for song playback, initiating song playback, and playing back an accompaniment. The second switch panel 103 is used to make song and accompaniment selections, select tone color, and so on. The liquid crystal display (LCD) 104 displays a musical score and lyrics during the playback of a song, and information relating to various settings. Although not illustrated in the drawings, the electronic keyboard instrument 100 is also provided with a speaker that emits musical sounds generated by playing of the electronic keyboard instrument 100. The speaker is provided at the underside, a side, the rear side, or other such location on the electronic keyboard instrument 100.

Figure 2:
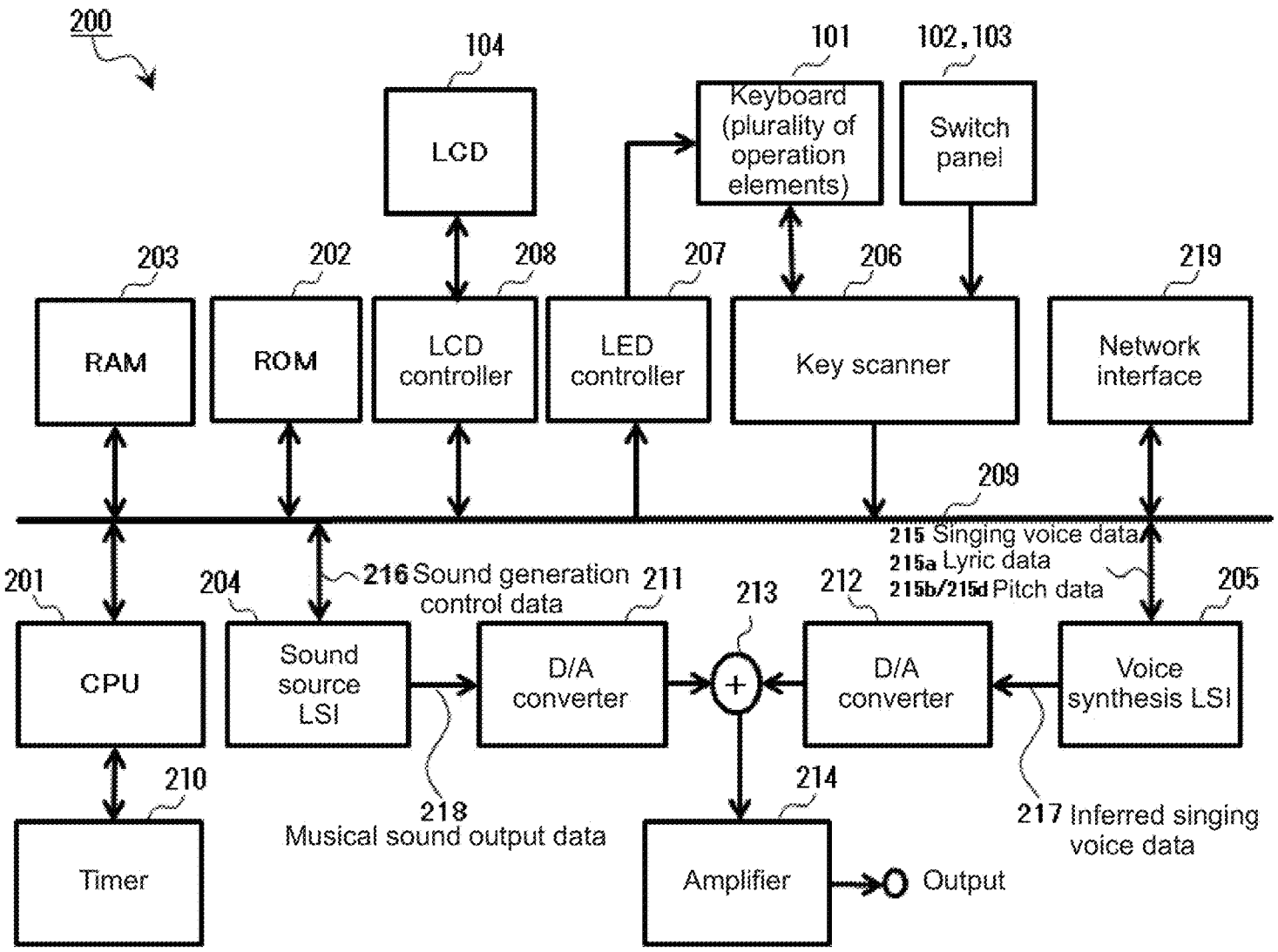
FIG. 2 is a block diagram illustrating an example hardware configuration for an embodiment of a control system of the electronic keyboard instrument.

FIG. 2 is a diagram illustrating an example hardware configuration for an embodiment of a control system 200 in the electronic keyboard instrument 100 of FIG. 1. In the control system 200 in FIG. 2, a central processing unit (CPU) 201, a read-only memory (ROM) 202, a random-access memory (RAM) 203, a sound source large-scale integrated circuit (LSI) 204, a voice synthesis LSI 205, a key scanner 206, an LED controller 207, and an LCD controller 208 are each connected to a system bus 209. The key scanner 206 is connected to the keyboard (a plurality of operation elements that include a first operation element and a second operation element) 101, to the first switch panel 102, and to the second switch panel 103 in FIG. 1. The LED controller 207 is connected to the keyboard 101. The LCD controller 208 is connected to the LCD 104 in FIG. 1. The CPU 201 is also connected to a timer 210 for controlling an automatic performance sequence. Musical sound output data 218 output from the sound source LSI 204 is converted into an analog musical sound output signal by a D/A converter 211, and inferred singing voice data 217 output from the voice synthesis LSI 205 is converted into an analog singing voice sound output signal by a D/A converter 212. The analog musical sound output signal and the analog singing voice sound output signal are mixed by a mixer 213, and after being amplified by an amplifier 214, this mixed signal is output from an output terminal or the non-illustrated speaker. The sound source LSI 204 and the voice synthesis LSI 205 may of course be integrated into a single LSI. The musical sound output data 218 and the inferred singing voice data 217, which are digital signals, may also be converted into an analog signal by a D/A converter after being mixed together by a mixer.

While using the RAM 203 as working memory, the CPU 201 executes a control program stored in the ROM 202 and thereby controls the operation of the electronic keyboard instrument 100 in FIG. 1. In addition to the aforementioned control program and various kinds of permanent data, the ROM 202 stores musical piece data including lyric data and accompaniment data.

The ROM 202 (memory) is also pre-stored with melody pitch data (215*d*) indicating operation elements that a user is to operate, singing voice output timing data (215*c*) indicating output timings at which respective singing voices for pitches indicated by the melody pitch data (215*d*) are to be output, and lyric data (215*a*) corresponding to the melody pitch data (215*d*).

The CPU 201 is provided with the timer 210 used in the present embodiment. The timer 210, for example, counts the progression of automatic performance in the electronic keyboard instrument 100.

Following a sound generation control instruction from the CPU 201, the sound source LSI 204 reads musical sound waveform data from a non-illustrated waveform ROM, for example, and outputs the musical sound waveform data to the D/A converter 211. The sound source LSI 204 is capable of 256-voice polyphony.

When the voice synthesis LSI 205 is given, as singing voice data 215, lyric data 215*a* and either pitch data 215*b* or melody pitch data 215*d* by the CPU 201, the voice synthesis LSI 205 synthesizes voice data for a corresponding singing voice and outputs this voice data to the D/A converter 212.

The lyric data 215*a* and the melody pitch data 215*d* are pre-stored in the ROM 202. Either the melody pitch data 215*d* pre-stored in the ROM 202 or pitch data 215*b* for a note number obtained in real time due to a user key press operation is input to the voice synthesis LSI 205 as pitch data.

In other words, when there is a user key press operation at a prescribed timing, an inferred singing voice is produced at a pitch corresponding to the key on which there was a key press operation, and when there is no user key press operation at a prescribed timing, an inferred singing voice is produced at a pitch indicated by the melody pitch data 215*d* stored in the ROM 202.

The key scanner 206 regularly scans the pressed/released states of the keys on the keyboard 101 and the operation states of the switches on the first switch panel 102 and the second switch panel 103 in FIG. 1, and sends interrupts to the CPU 201 to communicate any state changes.

The LCD controller 208 is an integrated circuit (IC) that controls the display state of the LCD 104.

Figure 3:
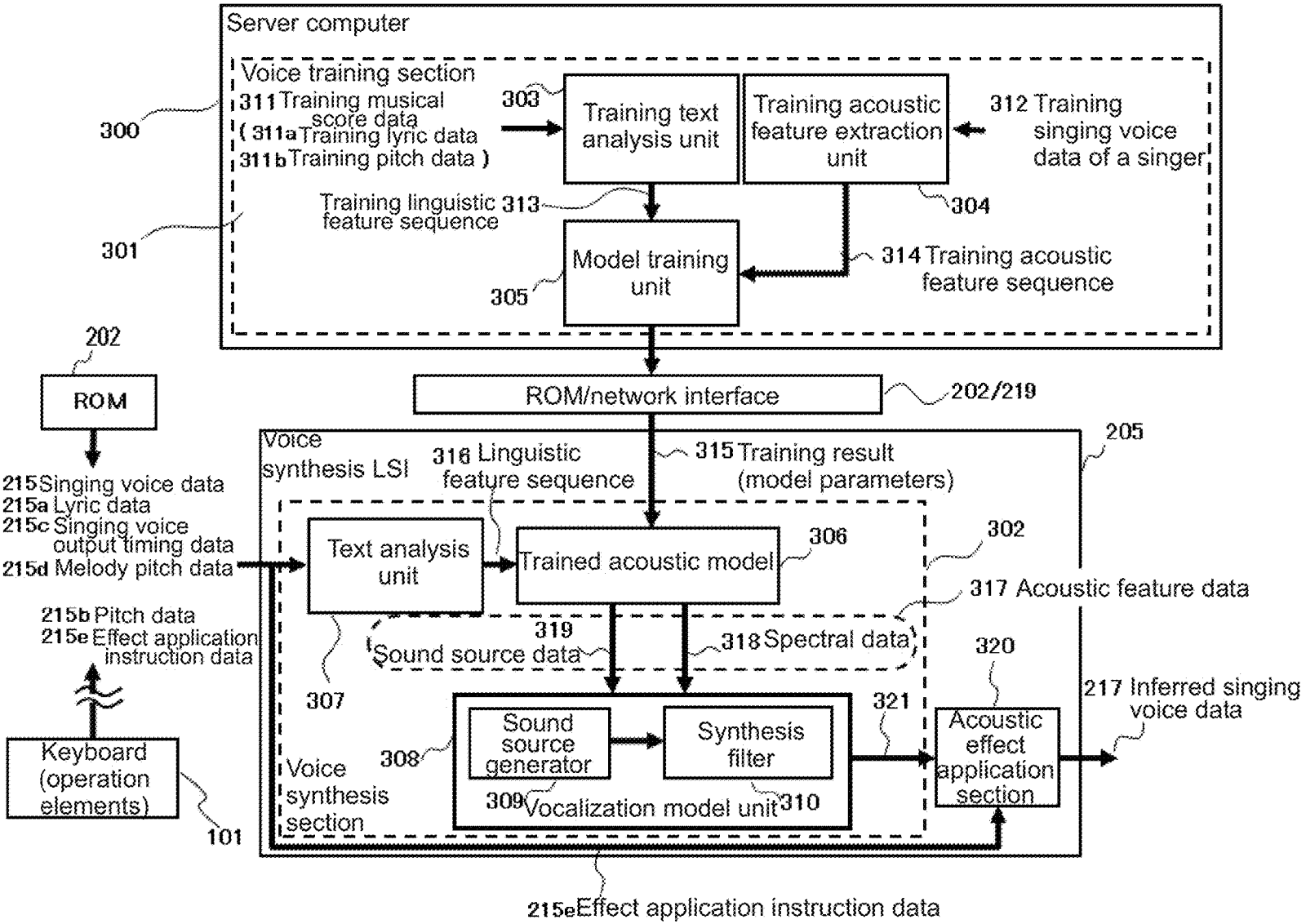
FIG. 3 is a block diagram illustrating an example configuration of a voice training section and a voice synthesis section.

FIG. 3 is a block diagram illustrating an example configuration of a voice synthesis section, an acoustic effect application section, and a voice training section of the present embodiment. The voice synthesis section 302 and the acoustic effect application section 320 are built into the electronic keyboard instrument 100 as part of functionality performed by the voice synthesis LSI 205 in FIG. 2.

Along with lyric data 215*a*, the voice synthesis section 302 is input with pitch data 215*b* instructed by the CPU 201 on the basis of a key press on the keyboard 101 in FIG. 1 via the key scanner 206. With this, the voice synthesis section 302 synthesizes and outputs output data 321. If no key on the keyboard 101 is pressed and pitch data 215*b* is not instructed by the CPU 201, melody pitch data 215*d* stored in memory is input to the voice synthesis section 302 in place of the pitch data 215*b*. A trained acoustic model 306 takes this data and outputs spectral data 318 and sound source data 319. The voice synthesis section 302 outputs inferred singing voice data 217 for which the singing voice of a given singer has been inferred on the basis of the spectral data 318 and the sound source data 319 output from the trained acoustic model 306. Thereby, even when a user does not press a key at a prescribed timing, a corresponding singing voice is produced at an output timing indicated by singing voice output timing data 215*c* stored in the ROM 202.

The acoustic effect application section 320 is input with effect application instruction data 215*e*, as a result of which the acoustic effect application section 320 applies an acoustic effect such as a vibrato effect, a tremolo effect, or a wah effect to the output data 321 output by the voice synthesis section 302.

Effect application instruction data 215*e* is input to the acoustic effect application section 320 in accordance with the pressing of a second key (for example, a black key) within a prescribed range from a first key that has been pressed by a user (for example, within one octave). The greater the difference in pitch between the first key and the second key, the greater the acoustic effect that is applied by the acoustic effect application section 320.

As illustrated in FIG. 3, the voice training section 301 may, for example, be implemented as part of functionality performed by a separate server computer 300 provided outside the electronic keyboard instrument 100 in FIG. 1. Alternatively, although not illustrated in FIG. 3, if the voice synthesis LSI 205 in FIG. 2 has spare processing capacity, the voice training section 301 may be built into the electronic keyboard instrument 100 and implemented as part of functionality performed by the voice synthesis LSI 205.

The voice training section 301 and the voice synthesis section 302 in FIG. 2 are implemented on the basis of, for example, the "statistical parametric speech synthesis based on deep learning" techniques described in Non-Patent Document 1, cited below.

(Non-Patent Document 1)

Kei Hashimoto and Shinji Takaki, "Statistical parametric speech synthesis based on deep learning", Journal of the Acoustical Society of Japan, vol. 73, no. 1 (2017), pp. 55-62

The voice training section 301 in FIG. 2, which is functionality performed by the external server computer 300 illustrated in FIG. 3, for example, includes a training text analysis unit 303, a training acoustic feature extraction unit 304, and a model training unit 305.

The voice training section 301, for example, uses voice sounds that were recorded when a given singer sang a plurality of songs in an appropriate genre as training singing voice data for a given singer 312. Lyric text (training lyric data 311*a*) for each song is also prepared as training musical score data 311.

The training text analysis unit 303 is input with training musical score data 311, including lyric text (training lyric data 311*a*) and musical note data (training pitch data 311*b*), and the training text analysis unit 303 analyzes this data. The training text analysis unit 303 accordingly estimates and outputs a training linguistic feature sequence 313, which is a discrete numerical sequence expressing, inter alia, phonemes and pitches corresponding to the training musical score data 311.

In addition to this input of training musical score data 311, the training acoustic feature extraction unit 304 receives and analyzes training singing voice data for a given singer 312 that has been recorded via a microphone or the like when a given singer sang (for approximately two to three hours, for example) lyric text corresponding to the training musical score data 311. The training acoustic feature extraction unit 304 accordingly extracts and outputs a training acoustic feature sequence 314 representing phonetic features corresponding to the training singing voice data for a given singer 312.

As described in Non-Patent Document 1, in accordance with Equation (1) below, the model training unit 305 uses machine learning to estimate an acoustic model $\hat{\lambda}$ with which the probability ($P(o|l,\lambda)$) that a training acoustic feature sequence 314 (o) will be generated given a training linguistic feature sequence 313 (l) and an acoustic model ($\lambda$) is maximized. In other words, a relationship between a linguistic feature sequence (text) and an acoustic feature sequence (voice sounds) is expressed using a statistical model, which here is referred to as an acoustic model.

$$\hat{\lambda}=\arg\max_{\lambda} P(o|l,\lambda) \tag{1}$$

Here, arg max denotes a computation that calculates the value of the argument underneath arg max that yields the greatest value for the function to the right of arg max.

The model training unit 305 outputs, as training result 315, model parameters expressing the acoustic model $\hat{\lambda}$ that have been calculated using Equation (1) through the employ of machine learning.

As illustrated in FIG. 3, the training result 315 (model parameters) may, for example, be stored in the ROM 202 of the control system in FIG. 2 for the electronic keyboard instrument 100 in FIG. 1 when the electronic keyboard instrument 100 is shipped from the factory, and may be loaded into the trained acoustic model 306, described later, in the voice synthesis LSI 205 from the ROM 202 in FIG. 2 when the electronic keyboard instrument 100 is powered on. Alternatively, as illustrated in FIG. 3, as a result of user operation of the second switch panel 103 on the electronic keyboard instrument 100, the training result 315 may, for example, be downloaded from the Internet, a universal serial bus (USB) cable, or other network via a non-illustrated network interface 219 and into the trained acoustic model 306, described later, in the voice synthesis LSI 205.

The voice synthesis section 302, which is functionality performed by the voice synthesis LSI 205, includes a text analysis unit 307, the trained acoustic model 306, and a vocalization model unit 308. The voice synthesis section 302 performs statistical voice synthesis processing in which output data 321, corresponding to singing voice data 215 including lyric text, is synthesized by making predictions using the statistical model referred to herein as the trained acoustic model 306.

As a result of a performance by a user made in concert with an automatic performance, the text analysis unit 307 is input with singing voice data 215, which includes information relating to phonemes, pitches, and the like for lyrics specified by the CPU 201 in FIG. 2, and the text analysis unit 307 analyzes this data. The text analysis unit 307 performs this analysis and outputs a linguistic feature sequence 316 expressing, inter alia, phonemes, parts of speech, and words corresponding to the singing voice data 215.

As described in Non-Patent Document 1, the trained acoustic model 306 is input with the linguistic feature sequence 316, and using this, the trained acoustic model 306 estimates and outputs an acoustic feature sequence 317 (acoustic feature data 317) corresponding thereto. In other words, in accordance with Equation (2) below, the trained acoustic model 306 estimates a value ($\hat{o}$) for an acoustic feature sequence 317 at which the probability ($P(o|l,\hat{\lambda})$) that an acoustic feature sequence 317 (o) will be generated based on a linguistic feature sequence 316 (l) input from the text analysis unit 307 and an acoustic model set using the training result 315 of machine learning performed in the model training unit 305 is maximized.

$$\hat{o}=\arg\max_{o} P(o|l,\hat{\lambda}) \quad (2)$$

The vocalization model unit 308 is input with the acoustic feature sequence 317. With this, the vocalization model unit 308 generates output data 321 corresponding to the singing voice data 215 including lyric text specified by the CPU 201. An acoustic effect is applied to the output data 321 in the acoustic effect application section 320, described later, and the output data 321 is converted into the final inferred singing voice data 217. This inferred singing voice data 217 is output from the D/A converter 212, goes through the mixer 213 and the amplifier 214 in FIG. 2, and is emitted from the non-illustrated speaker.

The acoustic features expressed by the training acoustic feature sequence 314 and the acoustic feature sequence 317 include spectral data that models the vocal tract of a person, and sound source data that models the vocal cords of a person. A mel-cepstrum, line spectral pairs (LSP), or the like may be employed for the spectral data (parameters). A power value and a fundamental frequency (F0) indicating the pitch frequency of the voice of a person may be employed for the sound source data. The vocalization model unit 308 includes a sound source generator 309 and a synthesis filter 310. The sound source generator 309 models the vocal cords of a person, and is sequentially input with a sound source data 319 sequence from the trained acoustic model 306. Thereby, the sound source generator 309, for example, generates a sound source signal that is made up of a pulse train (for voiced phonemes) that periodically repeats with a fundamental frequency (F0) and power value contained in the sound source data 319, that is made up of white noise (for unvoiced phonemes) with a power value contained in the sound source data 319, or that is made up of a signal in which a pulse train and white noise are mixed together. The synthesis filter 310 models the vocal tract of a person. The synthesis filter 310 forms a digital filter that models the vocal tract on the basis of a spectral data 318 sequence sequentially input thereto from the trained acoustic model 306, and using the sound source signal input from the sound source generator 309 as an excitation signal, generates and outputs output data 321 in the form of a digital signal.

The sampling frequency of the training singing voice data for a given singer 312 is, for example, 16 kHz (kilohertz). When a mel-cepstrum parameter obtained through mel-cepstrum analysis, for example, is employed for a spectral parameter contained in the training acoustic feature sequence 314 and the acoustic feature sequence 317, the frame update period is, for example, 5 msec (milliseconds). In addition, when mel-cepstrum analysis is performed, the length of the analysis window is 25 msec, and the window function is a twenty-fourth-order Blackman window function.

An acoustic effect such as a vibrato effect, a tremolo effect, or a wah effect is applied to the output data 321 output from the voice synthesis section 302 by the acoustic effect application section 320 in the voice synthesis LSI 205.

A "vibrato effect" refers to an effect whereby, when a note in a song is drawn out, the pitch level is periodically varied by a prescribed amount (depth).

A "tremolo effect" refers to an effect whereby one or more notes are rapidly repeated.

A "wah effect" is an effect whereby the peak-gain frequency of a bandpass filter is moved so as to yield a sound resembling a voice saying "wah-wah".

When a user performs an operation whereby a second key (second operation element) on the keyboard 101 (FIG. 1) is repeatedly struck while a first key (first operation element) on the keyboard 101 for instructing a singing voice sound is causing output data 321 to be continuously output (while the first key is being pressed), an acoustic effect that has been pre-selected from among a vibrato effect, a tremolo effect, or a wah effect using the first switch panel 102 (FIG. 1) can be applied by the acoustic effect application section 320.

In this case, the user is able to vary the degree of the pitch effect in the acoustic effect application section 320 by, with respect to the pitch of the first key specifying a singing voice, specifying the second key that is repeatedly struck such that the difference in pitch between the second key and the first key is a desired difference. For example, the degree of the pitch effect can be made to vary such that the depth of the acoustic effect is set to a maximum value when the difference in pitch between the second key and the first key is one octave and such that the degree of the acoustic effect is weaker the lesser the difference in pitch.

The second key on the keyboard 101 that is repeatedly struck may be a white key. However, if the second key is a black key, for example, the second key is less liable to interfere with a performance operation on the first key for specifying the pitch of a singing voice sound.

In the present embodiment, it is thus possible to apply various additional acoustic effects in the acoustic effect application section 320 to output data 321 that is output from the voice synthesis section 302 to generate inferred singing voice data 217.

It should be noted that the application of an acoustic effect ends when no key presses on the second key have been detected for a set time (for example, several hundred milliseconds).

As another example, such an acoustic effect may be applied by just one press of the second key while the first key is being pressed, in other words, without repeatedly striking the second key as above. In this case too, the depth of the acoustic effect may change in accordance with the difference in pitch between the first key and the second key. The acoustic effect may be also applied while the second key is being pressed, and application of the acoustic effect ended in accordance with the detection of release of the second key.

As yet another example, such an acoustic effect may be applied even when the first key is released after the pressing the second key while the first key was being pressed. This kind of pitch effect may also be applied upon the detection of a "trill", whereby the first key and the second key are repeatedly struck in an alternating manner.

In the present specification, as a matter of convenience, the musical technique whereby such acoustic effects are applied is sometimes called "what is referred to as a legato playing style".

Next, a first embodiment of statistical voice synthesis processing performed by the voice training section 301 and the voice synthesis section 302 in FIG. 3 will be described. In the first embodiment of statistical voice synthesis processing, hidden Markov models (HMMs), described in Non-Patent Document 1 above and Non-Patent Document 2 below, are used for acoustic models expressed by the training result 315 (model parameters) set in the trained acoustic model 306.

(Non-Patent Document 2)

Shinji Sako, Keijiro Saino, Yoshihiko Nankaku, Keiichi Tokuda, and Tadashi Kitamura, "A trainable singing voice synthesis system capable of representing personal characteristics and singing styles", Information Processing Society of Japan (IPSJ) Technical Report, Music and Computer (MUS) 2008 (12 (2008-MUS-074)), pp. 39-44, 2008 Feb. 8

In the first embodiment of statistical voice synthesis processing, when a user vocalizes lyrics in accordance with a given melody, HMM acoustic models are trained on how singing voice feature parameters, such as vibration of the vocal cords and vocal tract characteristics, change over time during vocalization. More specifically, the HMM acoustic models model, on a phoneme basis, spectrum and fundamental frequency (and the temporal structures thereof) obtained from the training singing voice data.

First, processing by the voice training section 301 in FIG. 3 in which HMM acoustic models are employed will be described. As described in Non-Patent Document 2, the model training unit 305 in the voice training section 301 is input with a training linguistic feature sequence 313 output by the training text analysis unit 303 and a training acoustic feature sequence 314 output by the training acoustic feature extraction unit 304, and therewith trains maximum likelihood HMM acoustic models on the basis of Equation (1) above. The likelihood function for the HMM acoustic models is expressed by Equation (3) below.

$$\begin{aligned} P(o \mid l, \lambda) &= \sum_q P(o \mid q, \lambda) P(q \mid l, \lambda) \\ &= \sum_q \prod_{t=1}^{T} P(o_t \mid q_t, \lambda) P(q_t \mid q_{t-1}, l, \lambda) \\ &= \sum_q \prod_{t=1}^{T} \mathcal{N}(o_t \mid \mu_{q_t}, \Sigma_{q_t}) a_{q_{t-1} q_t} \end{aligned} \tag{3}$$

Here, $o_t$ represents an acoustic feature in frame t, T represents the number of frames, $q=(q_1, \ldots, q_T)$ represents the state sequence of a HMM acoustic model, and $q_t$ represents the state number of the HMM acoustic model in frame t. Further, $a_{q_{t-1}q_t}$ represents the state transition probability from state $q_{t-1}$ to state $q_t$, and $\mathcal{N}(o_t|\mu_{q_t},\Sigma_{q_t})$ is the normal distribution of a mean vector $\mu_{q_t}$ and a covariance matrix $\Sigma_{q_t}$ and represents an output probability distribution for state $q_t$. An expectation-maximization (EM) algorithm is used to efficiently train HMM acoustic models based on maximum likelihood criterion.

The spectral parameters of singing voice sounds can be modeled using continuous HMMs. However, because logarithmic fundamental frequency (F0) is a variable dimension time series signal that takes on a continuous value in voiced segments and is not defined in unvoiced segments, fundamental frequency (F0) cannot be directly modeled by regular continuous HMMs or discrete HMMs. Multi-space probability distribution HMMs (MSD-HMMs), which are HMMs based on a multi-space probability distribution compatible with variable dimensionality, are thus used to simultaneously model mel-cepstrums (spectral parameters), voiced sounds having a logarithmic fundamental frequency (F0), and unvoiced sounds as multidimensional Gaussian distributions, Gaussian distributions in one-dimensional space, and Gaussian distributions in zero-dimensional space, respectively.

As for the features of phonemes making up a singing voice, it is known that even for identical phonemes, acoustic features may vary due to being influenced by various factors. For example, the spectrum and logarithmic fundamental frequency (F0) of a phoneme, which is a basic phonological unit, may change depending on, for example, singing style, tempo, or on preceding/subsequent lyrics and pitches. Factors such as these that exert influence on acoustic features are called "context". In the first embodiment of statistical voice synthesis processing, HMM acoustic models that take context into account (context-dependent models) can be employed in order to accurately model acoustic features in voice sounds. Specifically, the training text analysis unit 303 may output a training linguistic feature sequence 313 that takes into account not only phonemes and pitch on a frame-by-frame basis, but also factors such as preceding and subsequent phonemes, accent and vibrato immediately prior to, at, and immediately after each position, and so on. In order to make dealing with combinations of context more efficient, decision tree based context clustering may be employed. Context clustering is a technique in which a binary tree is used to divide a set of HMM acoustic models into a tree structure, whereby HMM acoustic models are grouped into clusters having similar combinations of context. Each node within a tree is associated with a bifurcating question such as "Is the preceding phoneme/a/?" that distinguishes context, and each leaf node is associated with a training result 315 (model parameters) corresponding to a particular HMM acoustic model. For any combination of contexts, by traversing the tree in accordance with the questions at the nodes, one of the leaf nodes can be reached and the training result 315 (model parameters) corresponding to that leaf node selected. By selecting an appropriate decision tree structure, highly accurate and highly generalized HMM acoustic models (context-dependent models) can be estimated.

Figure 4:
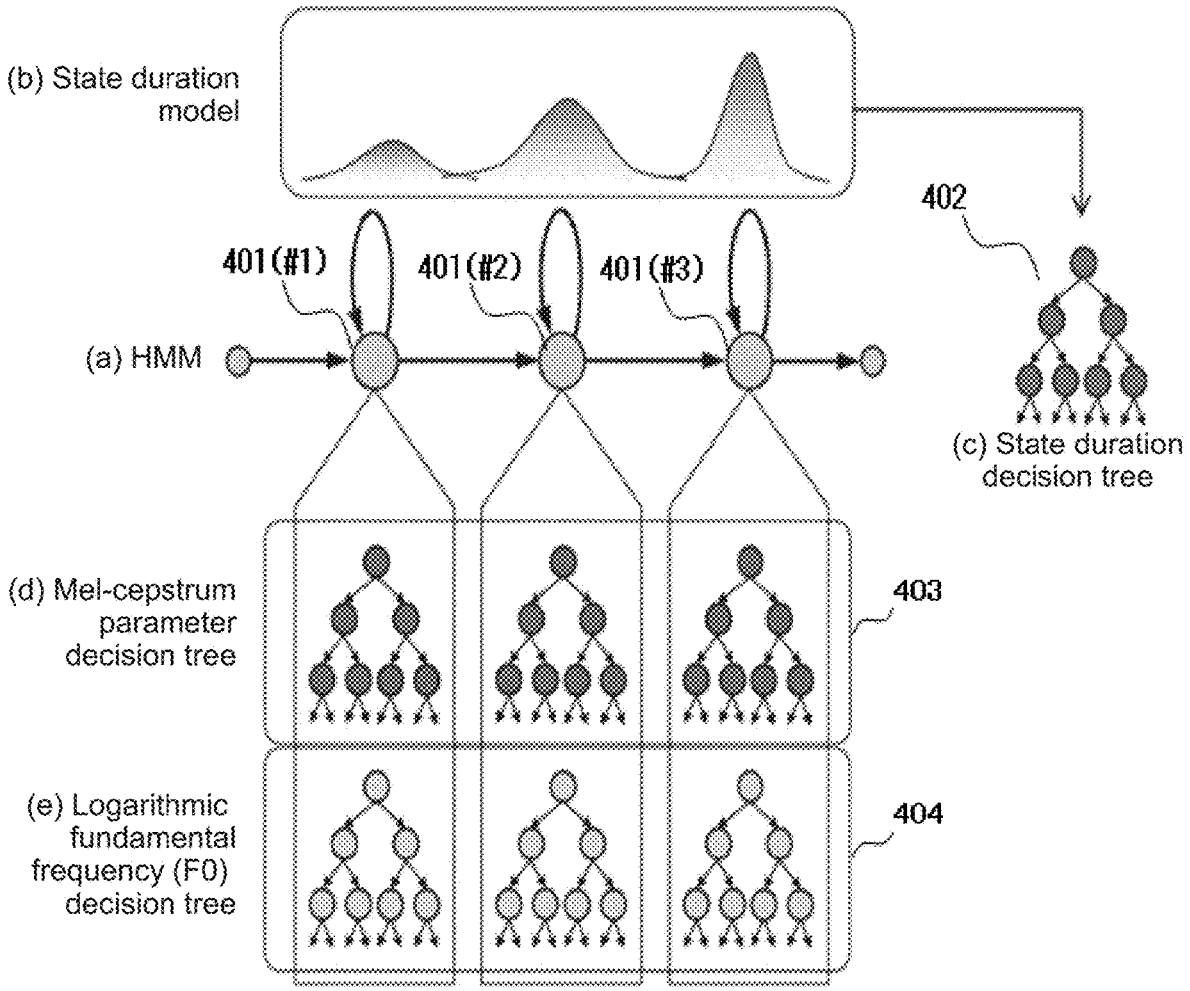
FIG. 4 is a diagram for explaining a first embodiment of statistical voice synthesis processing.

FIG. 4 is a diagram for explaining HMM decision trees in the first embodiment of statistical voice synthesis processing. States for each context-dependent phoneme are, for example, associated with a HMM made up of three states 401 (#1, #2, and #3) illustrated at (a) in FIG. 4. The arrows coming in and out of each state illustrate state transitions. For example, state 401 (#1) models the beginning of a phoneme. Further, state 401 (#2), for example, models the middle of the phoneme. Finally, state 401 (#3), for example, models the end of the phoneme.

The duration of states 401 #1 to #3 indicated by the HMM at (a) in FIG. 4, which depends on phoneme length, is determined using the state duration model at (b) in FIG. 4. As a result of training, the model training unit 305 in FIG. 3 generates a state duration decision tree 402 for determining state duration from a training linguistic feature sequence 313 corresponding to context for a large number of phonemes relating to state duration extracted from training musical score data 311 in FIG. 3 by the training text analysis unit 303 in FIG. 3, and this state duration decision tree 402 is set as a training result 315 in the trained acoustic model 306 in the voice synthesis section 302.

As a result of training, the model training unit 305 in FIG. 3 also, for example, generates a mel-cepstrum parameter decision tree 403 for determining mel-cepstrum parameters from a training acoustic feature sequence 314 corresponding to a large number of phonemes relating to mel-cepstrum parameters extracted from training singing voice data for a given singer 312 in FIG. 3 by the training acoustic feature extraction unit 304 in FIG. 3, and this mel-cepstrum parameter decision tree 403 is set as the training result 315 in the trained acoustic model 306 in the voice synthesis section 302.

As a result of training, the model training unit 305 in FIG. 3 also, for example, generates a logarithmic fundamental frequency decision tree 404 for determining logarithmic fundamental frequency (F0) from a training acoustic feature sequence 314 corresponding to a large number of phonemes relating to logarithmic fundamental frequency (F0) extracted from training singing voice data for a given singer 312 in FIG. 3 by the training acoustic feature extraction unit 304 in FIG. 3, and sets this logarithmic fundamental frequency decision tree 404 is set as the training result 315 in the trained acoustic model 306 in the voice synthesis section 302. It should be noted that as described above, voiced segments having a logarithmic fundamental frequency (F0) and unvoiced segments are respectively modeled as one-dimensional and zero-dimensional Gaussian distributions using MSD-HMMs compatible with variable dimensionality to generate the logarithmic fundamental frequency decision tree 404.

Moreover, as a result of training, the model training unit 305 in FIG. 3 may also generate a decision tree for determining context such as accent and vibrato on pitches from a training linguistic feature sequence 313 corresponding to context for a large number of phonemes relating to state duration extracted from training musical score data 311 in FIG. 3 by the training text analysis unit 303 in FIG. 3, and set this decision tree as the training result 315 in the trained acoustic model 306 in the voice synthesis section 302.

Next, processing by the voice synthesis section 302 in FIG. 3 in which HMM acoustic models are employed will be described. The trained acoustic model 306 is input with a linguistic feature sequence 316 output by the text analysis unit 307 relating to phonemes in lyrics, pitch, and other context. For each context, the trained acoustic model 306 references the decision trees 402, 403, 404, etc., illustrated in FIG. 4, concatenates the HMMs, and then predicts the acoustic feature sequence 317 (spectral data 318 and sound source data 319) with the greatest probability of being output from the concatenated HMMs.

As described in the above-referenced Non-Patent Documents, in accordance with Equation (2), the trained acoustic model 306 estimates a value ($\hat{o}$) for an acoustic feature sequence 317 at which the probability ($P(o|l,\hat{\lambda})$) that an acoustic feature sequence 317 (o) will be generated based on a linguistic feature sequence 316 (l) input from the text analysis unit 307 and an acoustic model $\hat{\lambda}$ set using the training result 315 of machine learning performed in the model training unit 305 is maximized. Using the state sequence $\hat{q}=\arg\max_q P(q|l,\hat{\lambda})$ estimated by the state duration model at (b) in FIG. 4, Equation (2) is approximated as in Equation (4) below.

$$\begin{aligned}\hat{o} &= \arg max_o \sum_q P(o \mid q, \hat{\lambda}) P(q \mid l, \hat{\lambda}) \\ &\approx \arg max_o P(o \mid \hat{q}, \hat{\lambda}) \\ &= \arg max_o \mathcal{N}(o \mid \mu_{\hat{q}}, \Sigma_{\hat{q}}) \\ &= \mu_{\hat{q}}\end{aligned} \tag{4}$$

Here, $$\mu_{\hat{q}}=[\mu_{\hat{q}_1}{}^T, \ldots, \mu_{\hat{q}_T}{}^T]^T$$

$$\Sigma_{\hat{q}}=\mathrm{diag}[\Sigma_{\hat{q}_1}, \ldots, \Sigma_{\hat{q}_T}],$$

and $\mu_{\hat{q}_t}$ and $\Sigma_{\hat{q}_t}$ are the mean vector and the covariance matrix, respectively, in state $\hat{q}_t$. Using linguistic feature sequence l, the mean vectors and the covariance matrices are calculated by traversing each decision tree that has been set in the trained acoustic model 306. According to Equation (4), the estimated value ($\hat{o}$) for an acoustic feature sequence 317 is obtained using the mean vector $\mu_{\hat{q}}$. However, $\mu_{\hat{q}}$ is a discontinuous sequence that changes in a step-like manner where there is a state transition. In terms of naturalness, low quality voice synthesis results when the synthesis filter 310 synthesizes output data 321 from a discontinuous acoustic feature sequence 317 such as this. In the first embodiment of statistical voice synthesis processing, a training result 315 (model parameter) generation algorithm that takes dynamic features into account may accordingly be employed in the model training unit 305. In cases where an acoustic feature sequence ($o_t=[c_t{}^T,\Delta c_t{}^T]^T$) in frame t is composed of a static feature $c_t$ and a dynamic feature $\Delta c_t$, the acoustic feature sequence ($o=[o_1{}^T, \ldots, o_T{}^T]^T$) is expressed over all times with Equation (5) below.

$$o=Wc \tag{5}$$

Here, W is a matrix whereby an acoustic feature sequence o containing a dynamic feature is obtained from static feature sequence $c=[c_1{}^T, \ldots, c_T{}^T]^T$. With Equation (5) as a constraint, the model training unit 305 solves Equation (4) as expressed by Equation (6) below.

$$\hat{c}=\arg\max_c \mathcal{N}(Wc|\mu_{\hat{q}},\Sigma_{\hat{q}}) \tag{6}$$

Here, $\hat{c}$ is the static feature sequence with the greatest probability of output under dynamic feature constraint. By taking dynamic features into account, discontinuities at state boundaries can be resolved, enabling a smoothly changing acoustic feature sequence 317 to be obtained. This also makes it possible for high quality singing voice sound output data 321 to be generated in the synthesis filter 310.

It should be noted that phoneme boundaries in the singing voice data often are not aligned with the boundaries of musical notes established by the musical score. Such time-wise fluctuations are considered to be essential in terms of musical expression. Accordingly, in the first embodiment of statistical voice synthesis processing employing HMM acoustic models described above, in the vocalization of singing voices, a technique may be employed that assumes that there will be time disparities due to various influences, such as phonological differences during vocalization, pitch, or rhythm, and that models lag between vocalization timings in the training data and the musical score. Specifically, as a model for lag on a musical note basis, lag between a singing voice, as viewed in units of musical notes, and a musical score may be represented using a one-dimensional Gaussian distribution and handled as a context-dependent HMM acoustic model similarly to other spectral parameters, logarithmic fundamental frequencies (F0), and the like. In singing voice synthesis such as this, in which HMM acoustic models that include context for "lag" are employed, after the boundaries in time represented by a musical score have been established, maximizing the joint probability of both the phoneme state duration model and the lag model on a musical note basis makes it possible to determine a temporal structure that takes fluctuations of musical note in the training data into account.

Next, a second embodiment of the statistical voice synthesis processing performed by the voice training section 301 and the voice synthesis section 302 in FIG. 3 will be described. In the second embodiment of statistical voice synthesis processing, in order to predict an acoustic feature sequence 317 from a linguistic feature sequence 316, the trained acoustic model 306 is implemented using a deep neural network (DNN). Correspondingly, the model training unit 305 in the voice training section 301 learns model parameters representing non-linear transformation functions for neurons in the DNN that transform linguistic features into acoustic features, and the model training unit 305 outputs, as the training result 315, these model parameters to the DNN of the trained acoustic model 306 in the voice synthesis section 302.

As described in the above-referenced Non-Patent Documents, normally, acoustic features are calculated in units of frames that, for example, have a width of 5.1 msec (milliseconds), and linguistic features are calculated in phoneme units. Accordingly, the unit of time for linguistic features differs from that for acoustic features. In the first embodiment of statistical voice synthesis processing in which HMM acoustic models are employed, correspondence between acoustic features and linguistic features is expressed using a HMM state sequence, and the model training unit 305 automatically learns the correspondence between acoustic features and linguistic features based on the training musical score data 311 and training singing voice data for a given singer 312 in FIG. 3. In contrast, in the second embodiment of statistical voice synthesis processing in which a DNN is employed, the DNN set in the trained acoustic model 306 is a model that represents a one-to-one correspondence between an input linguistic feature sequence 316 and an output acoustic feature sequence 317, and so the DNN cannot be trained using an input-output data pair having differing units of time. For this reason, in the second embodiment of statistical voice synthesis processing, the correspondence between acoustic feature sequences given in frames and linguistic feature sequences given in phonemes is established in advance, whereby pairs of acoustic features and linguistic features given in frames are generated.

Figure 5:
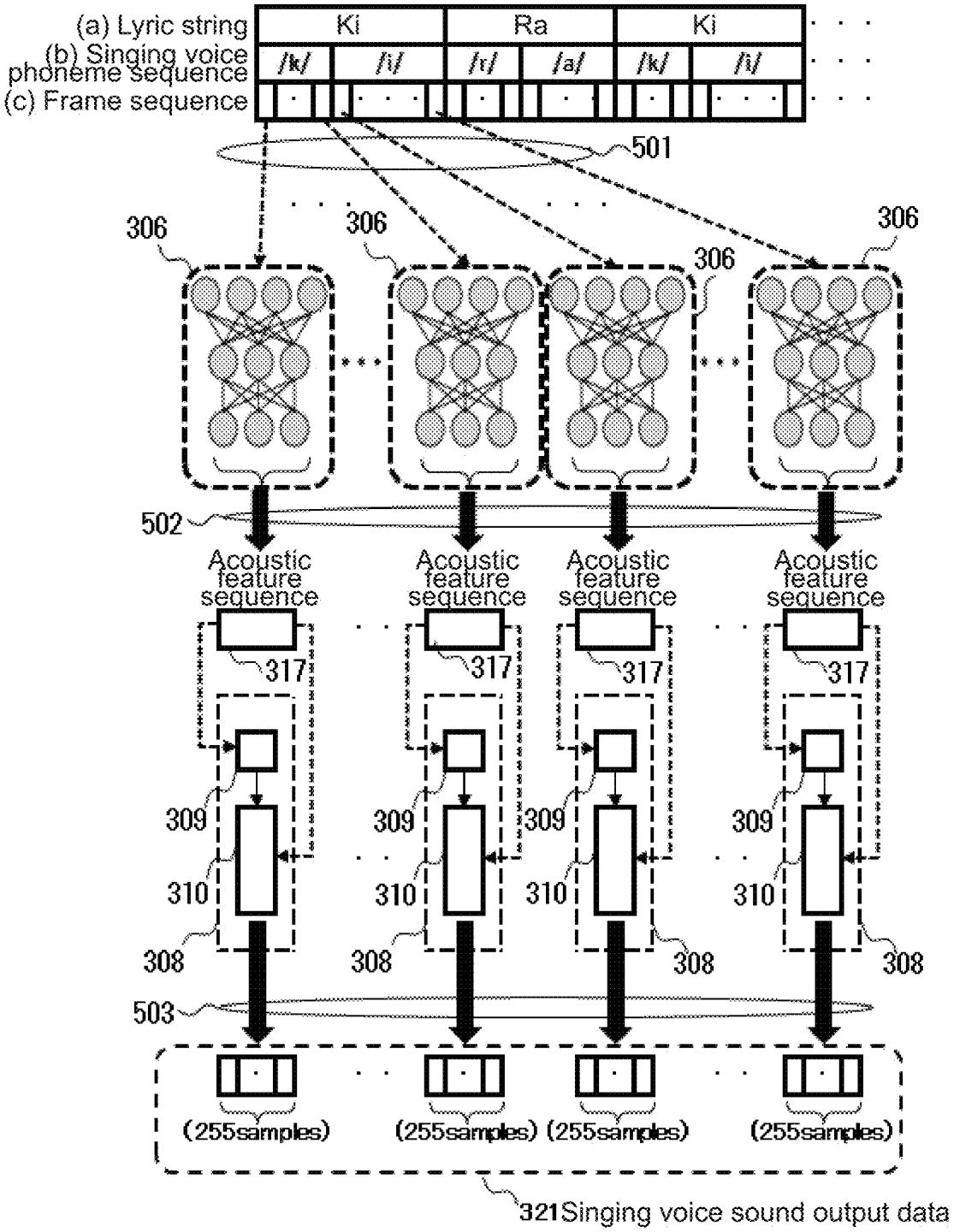
FIG. 5 is a diagram for explaining a second embodiment of statistical voice synthesis processing.

FIG. 5 is a diagram for explaining the operation of the voice synthesis LSI 205, and illustrates the aforementioned correspondence. For example, when the singing voice phoneme sequence (linguistic feature sequence) /k/ /i/ /r/ /a/ /k/ /i/ ((b) in FIG. 5) corresponding to the lyric string "Ki Ra Ki" ((a) in FIG. 5) at the beginning of a song has been acquired, this linguistic feature sequence is mapped to an acoustic feature sequence given in frames ((c) in FIG. 5) in a one-to-many relationship (the relationship between (b) and (c) in FIG. 5). It should be noted that because linguistic features are used as inputs to the DNN of the trained acoustic model 306, it is necessary to express the linguistic features as numerical data. Numerical data obtained by concatenating binary data (0 or 1) or continuous values responsive to contextual questions such as "Is the preceding phoneme /a/?" and "How many phonemes does the current word contain?" is prepared for the linguistic feature sequence for this reason.

In the second embodiment of statistical voice synthesis processing, the model training unit 305 in the voice training section 301 in FIG. 3, as depicted using the group of dashed arrows 501 in FIG. 5, trains the DNN of the trained acoustic model 306 by sequentially passing, in frames, pairs of individual phonemes in a training linguistic feature sequence 313 phoneme sequence (corresponding to (b) in FIG. 5) and individual frames in a training acoustic feature sequence 314 (corresponding to (c) in FIG. 5) to the DNN. The DNN of the trained acoustic model 306, as depicted using the groups of gray circles in FIG. 5, contains neuron groups each made up of an input layer, one or more middle layer, and an output layer.

During voice synthesis, a linguistic feature sequence 316 phoneme sequence (corresponding to (b) in FIG. 5) is input to the DNN of the trained acoustic model 306 in frames. The DNN of the trained acoustic model 306, as depicted using the group of heavy solid arrows 502 in FIG. 5, consequently outputs an acoustic feature sequence 317 in frames. For this reason, in the vocalization model unit 308, the sound source data 319 and the spectral data 318 contained in the acoustic feature sequence 317 are respectively passed to the sound source generator 309 and the synthesis filter 310, and voice synthesis is performed in frames.

The vocalization model unit 308, as depicted using the group of heavy solid arrows 503 in FIG. 5, consequently outputs 225 samples, for example, of output data 321 per frame. Because each frame has a width of 5.1 msec, one sample corresponds to 5.1 msec÷225≈0.0227 msec. The sampling frequency of the output data 321 is therefore 1/0.0227≈44 kHz (kilohertz).

As described in the above-referenced Non-Patent Documents, the DNN is trained so as to minimize squared error. This is computed according to Equation (7) below using pairs of acoustic features and linguistic features denoted in frames.

$$\hat{\lambda}=\arg\min_{\lambda} \tfrac{1}{2}\Sigma_{t=1}^{T}\|o_t-g_{\lambda}(l_t)\|^2 \tag{7}$$

In this equation, $o_t$ and $l_t$ respectively represent an acoustic feature and a linguistic feature in the $t^{th}$ frame t, $\hat{\lambda}$ represents model parameters for the DNN of the trained acoustic model 306, and $g_{\lambda}(\bullet)$ is the non-linear transformation function represented by the DNN. The model parameters for the DNN are able to be efficiently estimated through backpropagation. When correspondence with processing within the model training unit 305 in the statistical voice synthesis represented by Equation (1) is taken into account, DNN training can represented as in Equation (8) below.

$$\begin{aligned}\hat{\lambda} &= \arg max_{\lambda}\, P(o \mid l, \lambda) \\ &= \arg max_{\lambda} \prod_{t=1}^{T} \mathcal{N}(o_t \mid \tilde{\mu}_t, \tilde{\Sigma}_t)\end{aligned} \tag{8}$$

Here, $\tilde{\mu}_t$ is given as in Equation (9) below.

$$\tilde{\mu}_t=g_{\lambda}(l_t) \tag{9}$$

As in Equation (8) and Equation (9), relationships between acoustic features and linguistic features are able to be expressed using the normal distribution $\mathcal{N}(o_t|\tilde{\mu}_t,\tilde{\Sigma}_t)$, which uses output from the DNN for the mean vector. In the second embodiment of statistical voice synthesis processing in which a DNN is employed, normally, independent covariance matrices are used for linguistic feature sequences $l_t$. In other words, in all frames, the same covariance matrix $\Sigma_g$ is used for the linguistic feature sequences $l_t$. When the covariance matrix $\Sigma_g$ is an identity matrix, Equation (8) expresses a training process equivalent to that in Equation (7).

As described in FIG. 5, the DNN of the trained acoustic model 306 estimates an acoustic feature sequence 317 for each frame independently. For this reason, the obtained acoustic feature sequences 317 contain discontinuities that lower the quality of voice synthesis. Accordingly, a parameter generation algorithm employing dynamic features similar to that used in the first embodiment of statistical voice synthesis processing is, for example, used in the present embodiment. This allows the quality of voice synthesis to be improved.

Detailed description follows regarding the operation of the embodiment of the electronic keyboard instrument 100 of FIGS. 1 and 2 in which the statistical voice synthesis processing described in FIGS. 3 to 5 is employed. FIG. 6 is a diagram illustrating, for the present embodiment, an example data configuration for musical piece data loaded into the RAM 203 from the ROM 202 in FIG. 2. This example data configuration conforms to the Standard MIDI (Musical Instrument Digital Interface) File format, which is one file format used for MIDI files. The musical piece data is configured by data blocks called "chunks". Specifically, the musical piece data is configured by a header chunk at the beginning of the file, a first track chunk that comes after the header chunk and stores lyric data for a lyric part, and a second track chunk that stores performance data for an accompaniment part.

The header chunk is made up of five values: ChunkID, ChunkSize, FormatType, NumberOfTrack, and TimeDivision. ChunkID is a four byte ASCII code "4D 54 68 64" (in base 16) corresponding to the four half-width characters "MThd", which indicates that the chunk is a header chunk. ChunkSize is four bytes of data that indicate the length of the FormatType, NumberOfTrack, and TimeDivision part of the header chunk (excluding ChunkID and ChunkSize). This length is always "00 00 00 06" (in base 16), for six bytes. FormatType is two bytes of data "00 01" (in base 16). This means that the format type is format 1, in which multiple tracks are used. NumberOfTrack is two bytes of data "00 02" (in base 16). This indicates that in the case of the present embodiment, two tracks, corresponding to the lyric part and the accompaniment part, are used. TimeDivision is data indicating a timebase value, which itself indicates resolution per quarter note. TimeDivision is two bytes of data "01 E0" (in base 16). In the case of the present embodiment, this indicates 480 in decimal notation.

The first and second track chunks are each made up of a ChunkID, ChunkSize, and performance data pairs. The performance data pairs are made up of DeltaTime_1[i] and Event_1[i] (for the first track chunk/lyric part), or DeltaTime_2[i] and Event_2[i] (for the second track chunk/accompaniment part). Note that $0 \le i \le L$ for the first track chunk/lyric part, and $0 \le i \le M$ for the second track chunk/accompaniment part. ChunkID is a four byte ASCII code "4D 54 72 6B" (in base 16) corresponding to the four half-width characters "MTrk", which indicates that the chunk is a track chunk. ChunkSize is four bytes of data that indicate the length of the respective track chunk (excluding ChunkID and ChunkSize).

DeltaTime_1[i] is variable-length data of one to four bytes indicating a wait time (relative time) from the execution time of Event_1[i−1] immediately prior thereto. Similarly, DeltaTime_2[i] is variable-length data of one to four bytes indicating a wait time (relative time) from the execution time of Event_2[i−1] immediately prior thereto. Event_1[i] is a meta event (timing information) designating the vocalization timing and pitch of a lyric in the first track chunk/lyric part. Event_2[i] is a MIDI event (timing information) designating "note on" or "note off" or is a meta event designating time signature in the second track chunk/accompaniment part. In each DeltaTime_1[i] and Event_1[i] performance data pair of the first track chunk/lyric part, Event_1[i] is executed after a wait of DeltaTime_1[i] from the execution time of the Event_1[i−1] immediately prior thereto. The vocalization and progression of lyrics is realized thereby. In each DeltaTime_2[i] and Event_2[i] performance data pair of the second track chunk/accompaniment part, Event_2[i] is executed after a wait of DeltaTime_2[i] from the execution time of the Event_2[i−1] immediately prior thereto. The progression of automatic accompaniment is realized thereby.

Figure 7:
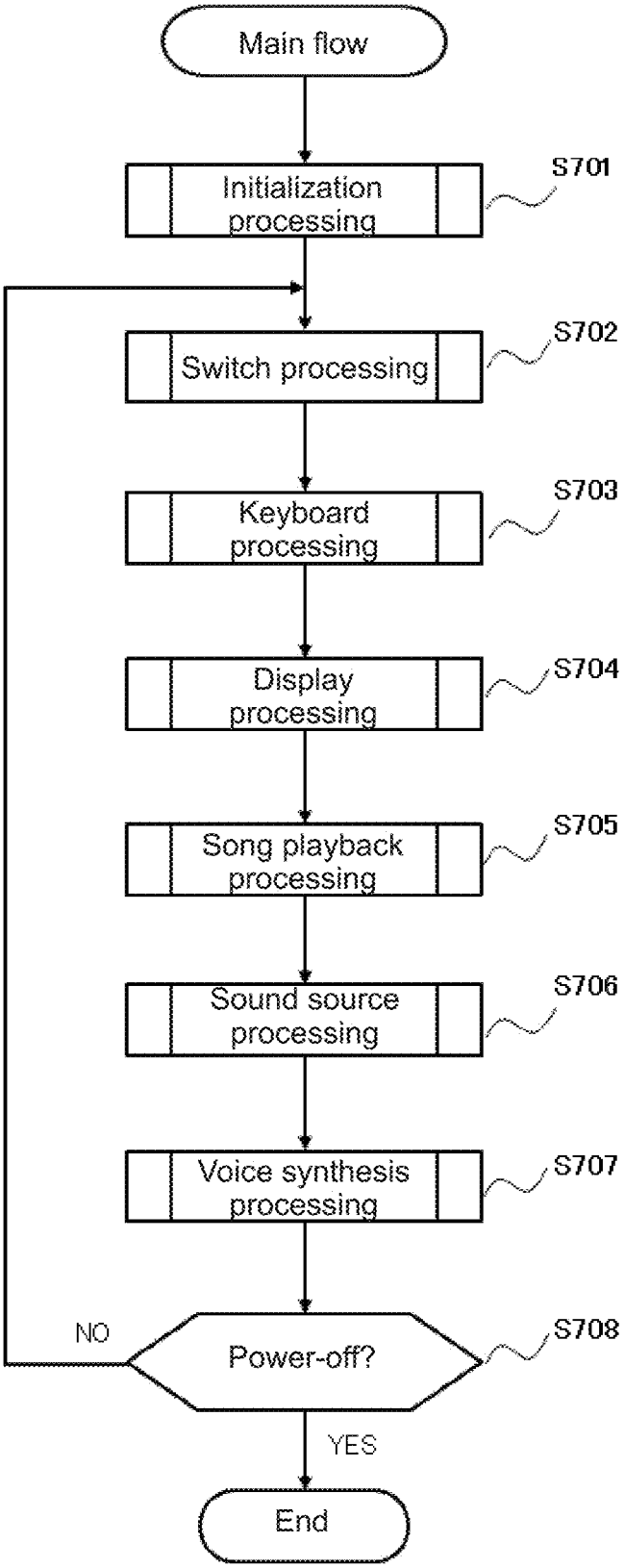
FIG. 7 is a main flowchart illustrating an example of a control process for the electronic musical instrument of the embodiments.

FIG. 7 is a main flowchart illustrating an example of a control process for the electronic musical instrument of the present embodiment. For this control process, for example, the CPU 201 in FIG. 2 executes a control processing program loaded into the RAM 203 from the ROM 202.

After first performing initialization processing (step S701), the CPU 201 repeatedly executes the series of processes from step S702 to step S708.

In this repeat processing, the CPU 201 first performs switch processing (step S702). Here, based on an interrupt from the key scanner 206 in FIG. 2, the CPU 201 performs processing corresponding to the operation of a switch on the first switch panel 102 or the second switch panel 103 in FIG. 1.

Next, based on an interrupt from the key scanner 206 in FIG. 2, the CPU 201 performs keyboard processing (step S703) that determines whether or not any of the keys on the keyboard 101 in FIG. 1 have been operated, and proceeds accordingly. Here, in response to an operation by a user pressing or releasing any of the keys, the CPU 201 outputs musical sound control data 216 instructing the sound source LSI 204 in FIG. 2 to start generating sound or to stop generating sound.

Next, the CPU 201 processes data that should be displayed on the LCD 104 in FIG. 1, and performs display processing (step S704) that displays this data on the LCD 104 via the LCD controller 208 in FIG. 2. Examples of the data that is displayed on the LCD 104 include lyrics corresponding to the inferred singing voice data 217 being performed, the musical score for the melody corresponding to the lyrics, and information relating to various settings.

Next, the CPU 201 performs song playback processing (step S705). In this processing, the CPU 201 performs a control process described in FIG. 5 on the basis of a performance by a user, generates singing voice data 215, and outputs this data to the voice synthesis LSI 205.

Then, the CPU 201 performs sound source processing (step S706). In the sound source processing, the CPU 201 performs control processing such as that for controlling the envelope of musical sounds being generated in the sound source LSI 204.

Then, the CPU 201 performs voice synthesis processing (step S707). In the voice synthesis processing, the CPU 201 controls voice synthesis by the voice synthesis LSI 205.

Finally, the CPU 201 determines whether or not a user has pressed a non-illustrated power-off switch to turn off the power (step S708). If the determination of step S708 is NO, the CPU 201 returns to the processing of step S702. If the determination of step S708 is YES, the CPU 201 ends the control process illustrated in the flowchart of FIG. 7 and powers off the electronic keyboard instrument 100.

Figure 8A:
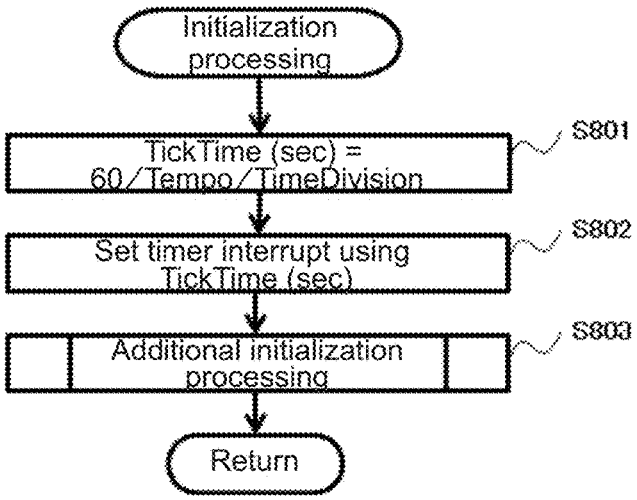
FIGS. 8A, 8B, and 8C depict flowcharts illustrating detailed examples of initialization processing, tempo-changing processing, and song-starting processing, respectively.
Figure 8B:
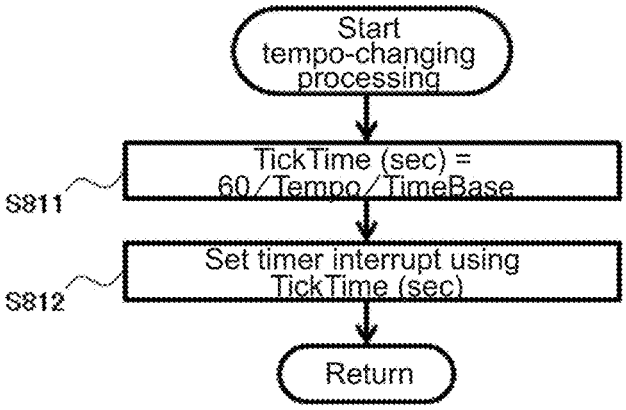
Figure 8C:
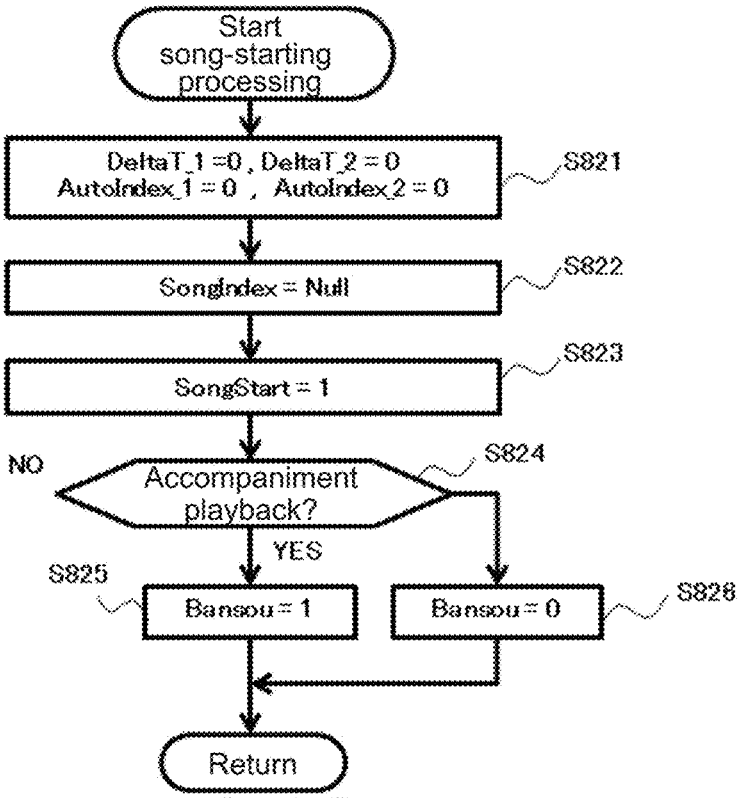

FIGS. 8A to 8C are flowcharts respectively illustrating detailed examples of the initialization processing at step S701 in FIG. 7; tempo-changing processing at step S902 in FIG. 9, described later, during the switch processing of step S702 in FIG. 7; and similarly, song-starting processing at step S906 in FIG. 9 during the switch processing of step S702 in FIG. 7, described later.

First, in FIG. 8A, which illustrates a detailed example of the initialization processing at step S701 in FIG. 7, the CPU 201 performs TickTime initialization processing. In the present embodiment, the progression of lyrics and automatic accompaniment progress in a unit of time called TickTime. The timebase value, specified as the TimeDivision value in the header chunk of the musical piece data in FIG. 6, indicates resolution per quarter note. If this value is, for example, 480, each quarter note has a duration of 480 TickTime. The DeltaTime_1[i] values and the DeltaTime_2[i] values, indicating wait times in the track chunks of the musical piece data in FIG. 6, are also counted in units of TickTime. The actual number of seconds corresponding to 1 TickTime differs depending on the tempo specified for the musical piece data. Taking a tempo value as Tempo (beats per minute) and the timebase value as TimeDivision, the number of seconds per unit of TickTime is calculated using the following equation.

$$\text{TickTime (sec)}=60/\text{Tempo}/\text{TimeDivision} \quad (10)$$

Accordingly, in the initialization processing illustrated in the flowchart of FIG. 8A, the CPU 201 first calculates TickTime (sec) by an arithmetic process corresponding to Equation (10) (step S801). A prescribed initial value for the tempo value Tempo, e.g., 60 (beats per second), is stored in the ROM 202 in FIG. 2. Alternatively, the tempo value from when processing last ended may be stored in non-volatile memory.

Next, the CPU 201 sets a timer interrupt for the timer 210 in FIG. 2 using the TickTime (sec) calculated at step S801 (step S802). A CPU 201 interrupt for lyric progression and automatic accompaniment (referred to below as an "automatic-performance interrupt") is thus generated by the timer 210 every time the TickTime (sec) has elapsed. Accordingly, in automatic-performance interrupt processing (FIG. 10, described later) performed by the CPU 201 based on an automatic-performance interrupt, processing to control lyric progression and the progression of automatic accompaniment is performed every 1 TickTime.

Then, the CPU 201 performs additional initialization processing, such as that to initialize the RAM 203 in FIG. 2 (step S803). The CPU 201 subsequently ends the initialization processing at step S701 in FIG. 7 illustrated in the flowchart of FIG. 8A.

The flowcharts in FIGS. 8B and 8C will be described later. FIG. 9 is a flowchart illustrating a detailed example of the switch processing at step S702 in FIG. 7.

First, the CPU 201 determines whether or not the tempo of lyric progression and automatic accompaniment has been changed using a switch for changing tempo on the first switch panel 102 in FIG. 1 (step S901). If this determination is YES, the CPU 201 performs tempo-changing processing (step S902). The details of this processing will be described later using FIG. 8B. If the determination of step S901 is NO, the CPU 201 skips the processing of step S902.

Next, the CPU 201 determines whether or not a song has been selected with the second switch panel 103 in FIG. 1 (step S903). If this determination is YES, the CPU 201 performs song-loading processing (step S904). In this processing, musical piece data having the data structure described in FIG. 6 is loaded into the RAM 203 from the ROM 202 in FIG. 2. The song-loading processing does not have to come during a performance, and may come before the start of a performance. Subsequent data access of the first track chunk or the second track chunk in the data structure illustrated in FIG. 6 is performed with respect to the musical piece data that has been loaded into the RAM 203. If the determination of step S903 is NO, the CPU 201 skips the processing of step S904.

Then, the CPU 201 determines whether or not a switch for starting a song on the first switch panel 102 in FIG. 1 has been operated (step S905). If this determination is YES, the CPU 201 performs song-starting processing (step S906). The details of this processing will be described later using FIG. 8C. If the determination of step S905 is NO, the CPU 201 skips the processing of step S906.

Then, the CPU 201 determines whether or not a switch for selecting an effect on the first switch panel 102 in FIG. 1 has been operated (step S907). If this determination is YES, the CPU 201 performs effect-selection processing (step S908). Here, as described above, a user selects which acoustic effect to apply from among a vibrato effect, a tremolo effect, or a wah effect using the first switch panel 102 when an acoustic effect is to be applied to the vocalized voice sound of the output data 321 output by the acoustic effect application section 320 in FIG. 3. As a result of this selection, the CPU 201 sets the acoustic effect application section 320 in the voice synthesis LSI 205 with whichever acoustic effect was selected. If the determination of step S907 is NO, the CPU 201 skips the processing of step S908.

Depending on the setting, a plurality of effects may be applied at the same time.

Finally, the CPU 201 determines whether or not any other switches on the first switch panel 102 or the second switch panel 103 in FIG. 1 have been operated, and performs processing corresponding to each switch operation (step S909). The CPU 201 subsequently ends the switch processing at step S702 in FIG. 7 illustrated in the flowchart of FIG. 9.

Figure 9:
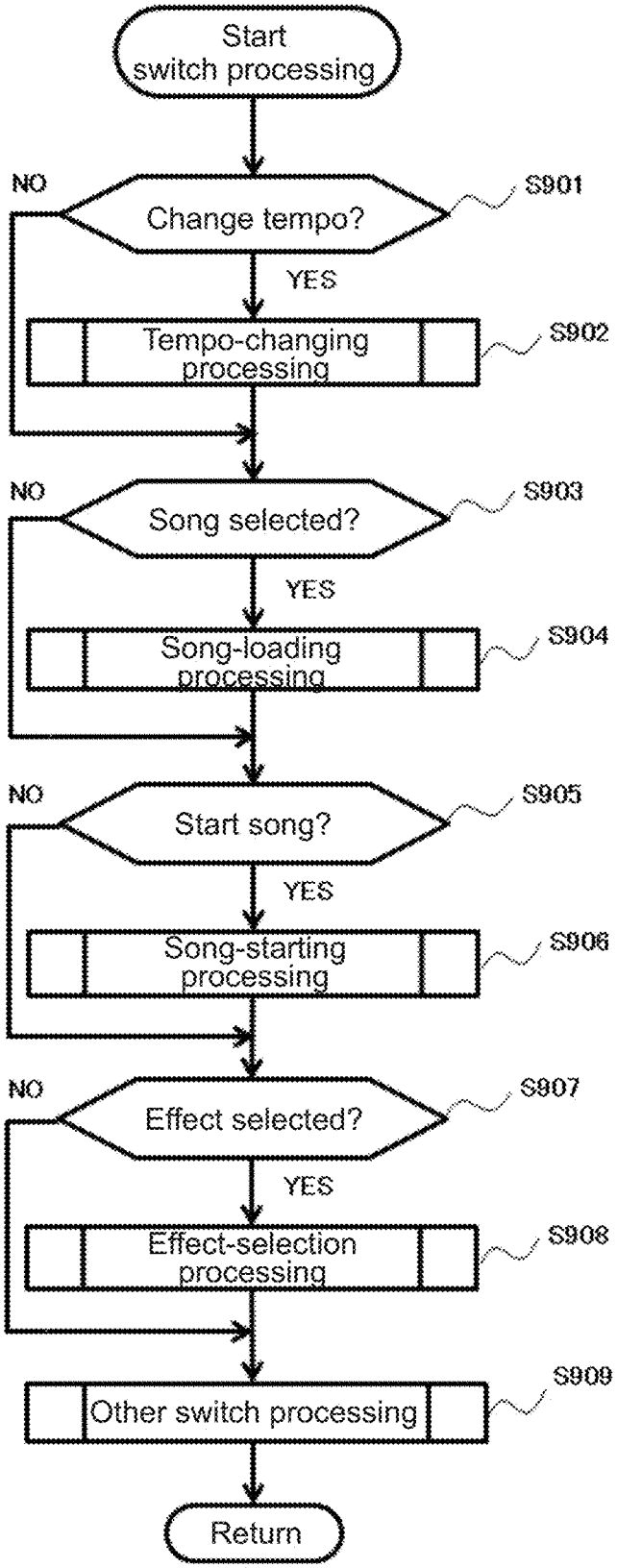
FIG. 9 is a flowchart illustrating a detailed example of switch processing.

FIG. 8B is a flowchart illustrating a detailed example of the tempo-changing processing at step S902 in FIG. 9. As mentioned previously, a change in the tempo value also results in a change in the TickTime (sec). In the flowchart of FIG. 8B, the CPU 201 performs a control process related to changing the TickTime (sec).

Similarly to at step S801 in FIG. 8A, which is performed in the initialization processing at step S701 in FIG. 7, the CPU 201 first calculates the TickTime (sec) by an arithmetic process corresponding to Equation (10) (step S811). It should be noted that the tempo value Tempo that has been changed using the switch for changing tempo on the first switch panel 102 in FIG. 1 is stored in the RAM 203 or the like.

Next, similarly to at step S802 in FIG. 8A, which is performed in the initialization processing at step S701 in FIG. 7, the CPU 201 sets a timer interrupt for the timer 210 in FIG. 2 using the TickTime (sec) calculated at step S811 (step S812). The CPU 201 subsequently ends the tempo-changing processing at step S902 in FIG. 9 illustrated in the flowchart of FIG. 8B.

FIG. 8C is a flowchart illustrating a detailed example of the song-starting processing at step S906 in FIG. 9.

First, with regards to the progression of automatic performance, the CPU 201 initializes the values of both a DeltaT_1 (first track chunk) variable and a DeltaT_2 (second track chunk) variable in the RAM 203 for counting, in units of TickTime, relative time since the last event to 0. Next, the CPU 201 initializes the respective values of an AutoIndex_1 variable in the RAM 203 for specifying an i value ($1 \leq i \leq L-1$) for DeltaTime_1[i] and Event_1[i] performance data pairs in the first track chunk of the musical piece data illustrated in FIG. 6, and an AutoIndex_2 variable in the RAM 203 for specifying an i ($1 \leq i \leq M-1$) for DeltaTime_2[i] and Event_2[i] performance data pairs in the second track chunk of the musical piece data illustrated in FIGS. 6, to 0 (the above is step S821). Thus, in the example of FIG. 6, the DeltaTime_1[0] and Event_1[0] performance data pair at the beginning of first track chunk and the DeltaTime_2[0] and Event_2[0] performance data pair at the beginning of second track chunk are both referenced to set an initial state.

Next, the CPU 201 initializes the value of a SongIndex variable in the RAM 203, which designates the current song position, to 0 (step S822).

The CPU 201 also initializes the value of a SongStart variable in the RAM 203, which indicates whether to advance (=1) or not advance (=0) the lyrics and accompaniment, to 1 (progress) (step S823).

Then, the CPU 201 determines whether or not a user has configured the electronic keyboard instrument 100 to playback an accompaniment together with lyric playback using the first switch panel 102 in FIG. 1 (step S824).

If the determination of step S824 is YES, the CPU 201 sets the value of a Bansou variable in the RAM 203 to 1 (has accompaniment) (step S825). Conversely, if the determination of step S824 is NO, the CPU 201 sets the value of the Bansou variable to 0 (no accompaniment) (step S826). After the processing at step S825 or step S826, the CPU 201 ends the song-starting processing at step S906 in FIG. 9 illustrated in the flowchart of FIG. 8C.

Figure 10:
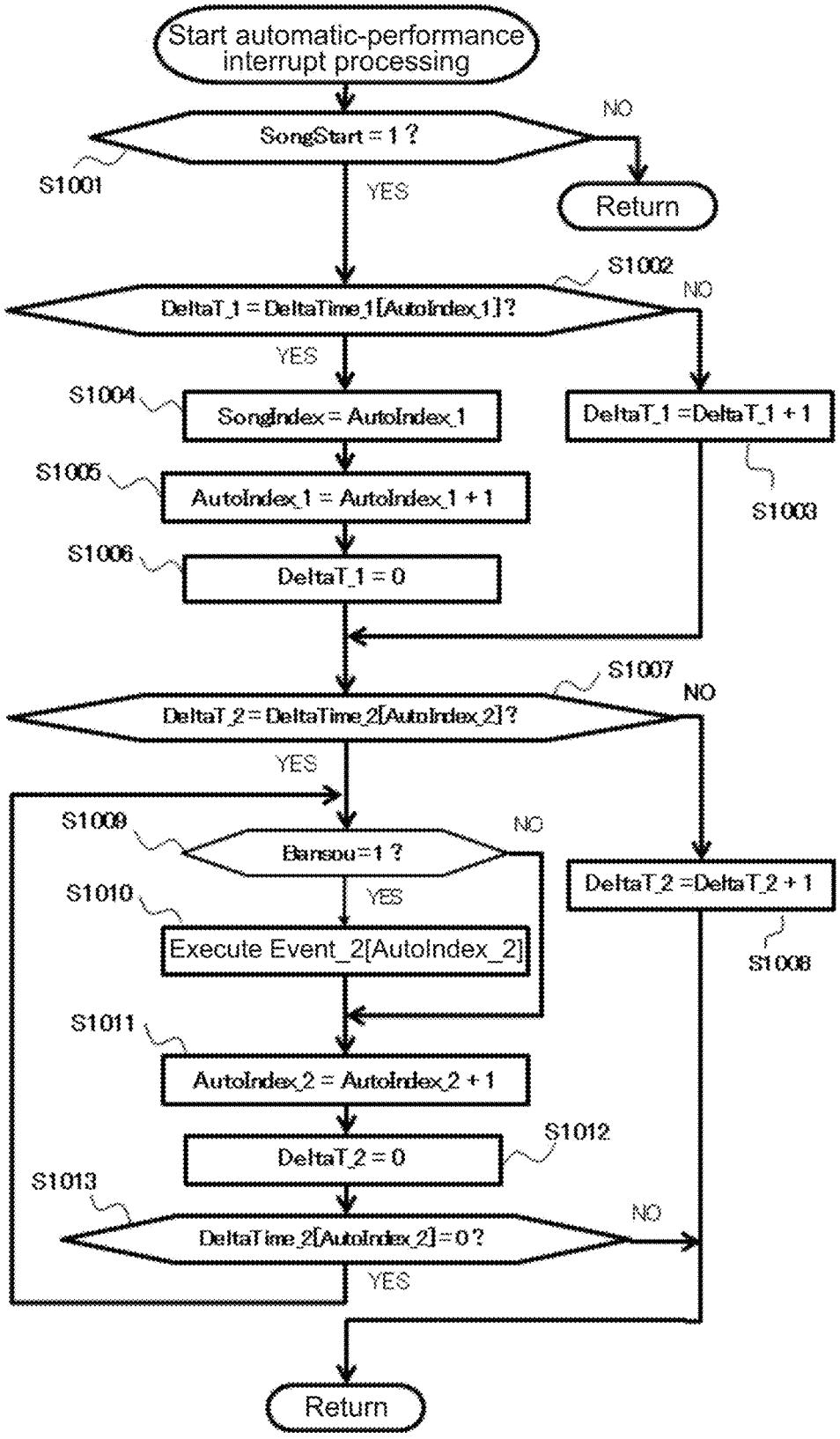
FIG. 10 is a flowchart illustrating a detailed example of automatic-performance interrupt processing.

FIG. 10 is a flowchart illustrating a detailed example of the automatic-performance interrupt processing performed based on the interrupts generated by the timer 210 in FIG. 2 every TickTime (sec) (see step S802 in FIG. 8A, or step S812 in FIG. 8B). The following processing is performed on the performance data pairs in the first and second track chunks in the musical piece data illustrated in FIG. 6.

First, the CPU 201 performs a series of processes corresponding to the first track chunk (steps S1001 to S1006). The CPU 201 starts by determining whether or not the value of SongStart is equal to 1, in other words, whether or not advancement of the lyrics and accompaniment has been instructed (step S1001).

When the CPU 201 has determined there to be no instruction to advance the lyrics and accompaniment (the determination of step S1001 is NO), the CPU 201 ends the automatic-performance interrupt processing illustrated in the flowchart of FIG. 10 without advancing the lyrics and accompaniment.

When the CPU 201 has determined there to be an instruction to advance the lyrics and accompaniment (the determination of step S1001 is YES), the CPU 201 then determines whether or not the value of DeltaT_1, which indicates the relative time since the last event in the first track chunk, matches the wait time DeltaTime_1[AutoIndex_1] of the performance data pair indicated by the value of AutoIndex_1 that is about to be executed (step S1002).

If the determination of step S1002 is NO, the CPU 201 increments the value of DeltaT_1, which indicates the relative time since the last event in the first track chunk, by 1, and the CPU 201 allows the time to advance by 1 TickTime corresponding to the current interrupt (step S1003). Following this, the CPU 201 proceeds to step S1007, which will be described later.

If the determination of step S1002 is YES, the CPU 201 executes the first track chunk event Event_1[AutoIndex_1] of the performance data pair indicated by the value of AutoIndex_1 (step S1004). This event is a song event that includes lyric data.

Then, the CPU 201 stores the value of AutoIndex_1, which indicates the position of the song event that should be performed next in the first track chunk, in the SongIndex variable in the RAM 203 (step S1004).

The CPU 201 then increments the value of AutoIndex_1 for referencing the performance data pairs in the first track chunk by 1 (step S1005).

Next, the CPU 201 resets the value of DeltaT_1, which indicates the relative time since the song event most recently referenced in the first track chunk, to 0 (step S1006). Following this, the CPU 201 proceeds to the processing at step S1007.

Then, the CPU 201 performs a series of processes corresponding to the second track chunk (steps S1007 to S1013). The CPU 201 starts by determining whether or not the value of DeltaT_2, which indicates the relative time since the last event in the second track chunk, matches the wait time DeltaTime_2[AutoIndex_2] of the performance data pair indicated by the value of AutoIndex_2 that is about to be executed (step S1007).

If the determination of step S1007 is NO, the CPU 201 increments the value of DeltaT_2, which indicates the relative time since the last event in the second track chunk, by 1, and the CPU 201 allows the time to advance by 1 TickTime corresponding to the current interrupt (step S1008). The CPU 201 subsequently ends the automatic-performance interrupt processing illustrated in the flowchart of FIG. 10.

If the determination of step S1007 is YES, the CPU 201 then determines whether or not the value of the Bansou variable in the RAM 203 that denotes accompaniment playback is equal to 1 (has accompaniment) (step S1009) (see steps S824 to S826 in FIG. 8C).

If the determination of step S1009 is YES, the CPU 201 executes the second track chunk accompaniment event Event_2[AutoIndex_2] indicated by the value of AutoIndex_2 (step S1010). If the event Event_2[AutoIndex_2] executed here is, for example, a "note on" event, the key number and velocity specified by this "note on" event are used to issue a command to the sound source LSI 204 in FIG. 2 to generate sound for a musical tone in the accompaniment. However, if the event Event_2[AutoIndex_2] is, for example, a "note off" event, the key number and velocity specified by this "note off" event are used to issue a command to the sound source LSI 204 in FIG. 2 to silence a musical tone being generated for the accompaniment.

However, if the determination of step S1009 is NO, the CPU 201 skips step S1010 and proceeds to the processing at the next step S1011 without executing the current accompaniment event Event_2[AutoIndex_2]. Here, in order to progress in sync with the lyrics, the CPU 201 performs only control processing that advances events.

After step S1010, or when the determination of step S1009 is NO, the CPU 201 increments the value of AutoIndex_2 for referencing the performance data pairs for accompaniment data in the second track chunk by 1 (step S1011).

Next, the CPU 201 resets the value of DeltaT_2, which indicates the relative time since the event most recently executed in the second track chunk, to 0 (step S1012).

Then, the CPU 201 determines whether or not the wait time DeltaTime_2[AutoIndex_2] of the performance data pair indicated by the value of AutoIndex_2 to be executed next in the second track chunk is equal to 0, or in other words, whether or not this event is to be executed at the same time as the current event (step S1013).

If the determination of step S1013 is NO, the CPU 201 ends the current automatic-performance interrupt processing illustrated in the flowchart of FIG. 10.

If the determination of step S1013 is YES, the CPU 201 returns to step S1009, and repeats the control processing relating to the event Event_2[AutoIndex_2] of the performance data pair indicated by the value of AutoIndex_2 to be executed next in the second track chunk. The CPU 201 repeatedly performs the processing of steps S1009 to S1013 same number of times as there are events to be simultaneously executed. The above processing sequence is performed when a plurality of "note on" events are to generate sound at simultaneous timings, as for example happens in chords and the like.

Figure 11:
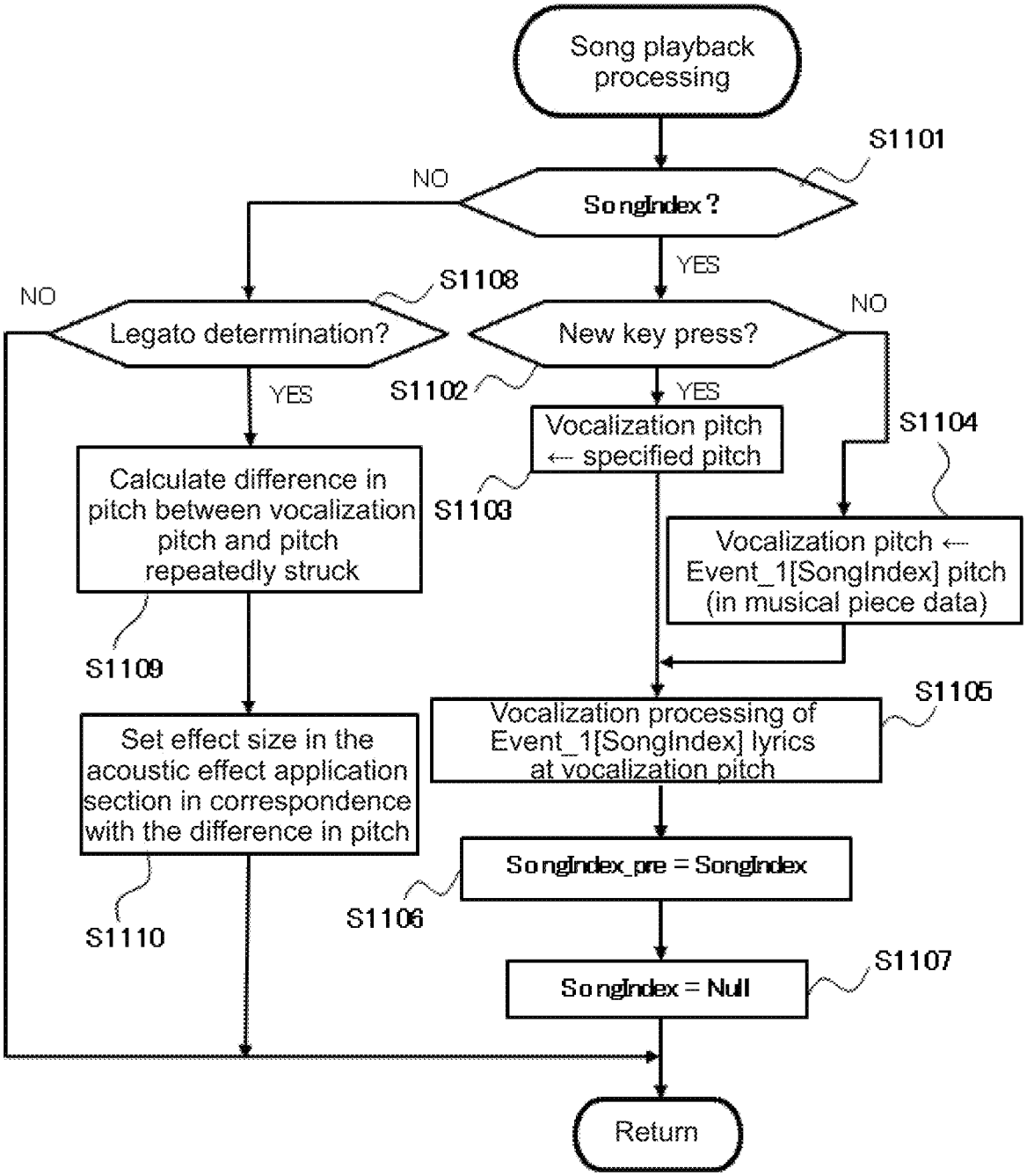
FIG. 11 is a flowchart illustrating a detailed example of song playback processing.

FIG. 11 is a flowchart illustrating a detailed example of the song playback processing at step S705 in FIG. 7.

First, at step S1004 in the automatic-performance interrupt processing of FIG. 10, the CPU 201 determines whether or not a value has been set for the SongIndex variable in the RAM 203, and that this value is not a null value (step S1101). The SongIndex value indicates whether or not the current timing is a singing voice playback timing.

If the determination of step S1101 is YES, that is, if the present time is a song playback timing, the CPU 201 then determines whether or not a new user key press on the keyboard 101 in FIG. 1 has been detected by the keyboard processing at step S703 in FIG. 7 (step S1102).

If the determination of step S1102 is YES, the CPU 201 sets the pitch specified by a user key press to a non-illustrated register, or to a variable in the RAM 203, as a vocalization pitch (step S1103).

Then, the CPU 201 reads the lyric string from the song event Event_1[SongIndex] in the first track chunk of the musical piece data in the RAM 203 indicated by the SongIndex variable in the RAM 203. The CPU 201 generates singing voice data 215 for vocalizing, at the vocalization pitch set to the pitch based on a key press that was set at step S1103, output data 321 corresponding to the lyric string that was read, and instructs the voice synthesis LSI 205 to perform vocalization processing (step S1105). The voice synthesis LSI 205 implements the first embodiment or the second embodiment of statistical voice synthesis processing described with reference to FIGS. 3 to 5, whereby lyrics from the RAM 203 specified as musical piece data are, in real time, synthesized into and output as inferred singing voice data 217 to be sung at the pitch of keys on the keyboard 101 pressed by a user.

If at step S1101 it is determined that the present time is a song playback timing and the determination of step S1102 is NO, that is, if it is determined that no new key press is detected at the present time, the CPU 201 reads the data for a pitch from the song event Event_1[SongIndex] in the first track chunk of the musical piece data in the RAM 203 indicated by the SongIndex variable in the RAM 203, and sets this pitch to a non-illustrated register, or to a variable in the RAM 203, as a vocalization pitch (step S1104).

Then, by performing the processing at step S1105, described above, the CPU 201 generates singing voice data 215 for vocalizing, at the vocalization pitch set at step S1104, output data 321 corresponding to the lyric string that was read from the song event Event_1[SongIndex], and instructs the voice synthesis LSI 205 to perform vocalization processing (step S1105). In implementing the first embodiment or the second embodiment of statistical voice synthesis processing described with reference to FIGS. 3 to 5, even if a user has not pressed a key on the keyboard 101, the voice synthesis LSI 205, as output data 321 to be sung in accordance with a default pitch specified in the musical piece data, synthesizes and outputs lyrics from the RAM 203 specified as musical piece data in a similar manner.

After the processing of step S1105, the CPU 201 stores the song position at which playback was performed indicated by the SongIndex variable in the RAM 203 in a SongIndex_pre variable in the RAM 203 (step S1106).

Then, the CPU 201 clears the value of the SongIndex variable so as to become a null value and makes subsequent timings non-song playback timings (step S1107). The CPU 201 subsequently ends the song playback processing at step S705 in FIG. 7 illustrated in the flowchart of FIG. 11.

If the determination of step S1101 is NO, that is, if the present time is not a song playback timing, the CPU 201 then determines whether or not "what is referred to as a legato playing style" for applying an effect has been detected on the keyboard 101 in FIG. 1 by the keyboard processing at step S703 in FIG. 7 (step S1108). As described above, this legato style of playing is a playing style in which, for example, while a first key is being pressed in order to playback a song at step S1102, another second key is repeatedly struck. In such case, at step S1108, if the speed of repetition of the presses is greater than or equal to a prescribed speed when the pressing of a second key has been detected, the CPU 201 determines that a legato playing style is being performed.

If the determination of step S1108 is NO, the CPU 201 ends the song playback processing at step S705 in FIG. 7 illustrated in the flowchart of FIG. 11.

If the determination of step S1108 is YES, the CPU 201 calculates the difference in pitch between the vocalization pitch set at step S1103 and the pitch of the key on the keyboard 101 in FIG. 1 being repeatedly struck in "what is referred to as a legato playing style" (step S1109).

Then, the CPU 201 sets the effect size in the acoustic effect application section 320 (FIG. 3) in the voice synthesis LSI 205 in FIG. 2 in correspondence with the difference in pitch calculated at step S1109 (step S1110). Consequently, the acoustic effect application section 320 subjects the output data 321 output from the synthesis filter 310 in the voice synthesis section 302 to processing to apply the acoustic effect selected at step S908 in FIG. 9 with the aforementioned size, and the acoustic effect application section 320 outputs the final inferred singing voice data 217 (FIG. 2, FIG. 3).

The processing of step S1109 and step S1110 enables an acoustic effect such as a vibrato effect, a tremolo effect, or a wah effect to be applied to output data 321 output from the voice synthesis section 302, and a variety of singing voice expressions are implemented thereby.

After the processing at step S1110, the CPU 201 ends the song playback processing at step S705 in FIG. 7 illustrated in the flowchart of FIG. 11.

In the first embodiment of statistical voice synthesis processing employing HMM acoustic models described with reference to FIGS. 3 and 4, it is possible to reproduce subtle musical expressions, such as for particular singers or singing styles, and it is possible to achieve a singing voice quality that is smooth and free of connective distortion. The training result 315 can be adapted to other singers, and various types of voices and emotions can be expressed, by performing a transformation on the training results 315

(model parameters). All model parameters for HMM acoustic models are able to be machine-learned from training musical score data 311 and training singing voice data for a given singer 312. This makes it possible to automatically create a voice synthesis system in which the features of a particular singer are acquired as HMM acoustic models and these features are reproduced during synthesis. The fundamental frequency and duration of a singing voice follows the melody and tempo in a musical score, and changes in pitch over time and the temporal structure of rhythm can be uniquely established from the musical score. However, a singing voice synthesized therefrom is dull and mechanical, and lacks appeal as a singing voice. Actual singing voices are not standardized as in a musical score, but rather have a style that is specific to each singer due to voice quality, pitch of voice, and changes in the structures thereof over time. In the first embodiment of statistical voice synthesis processing in which HMM acoustic models are employed, time series variations in spectral data and pitch information in a singing voice is able to be modeled on the basis of context, and by additionally taking musical score information into account, it is possible to reproduce a singing voice that is even closer to an actual singing voice. The HMM acoustic models employed in the first embodiment of statistical voice synthesis processing correspond to generative models that consider how, with regards to vibration of the vocal cords and vocal tract characteristics of a singer, an acoustic feature sequence of a singing voice changes over time during vocalization when lyrics are vocalized in accordance with a given melody. In the first embodiment of statistical voice synthesis processing, HMM acoustic models that include context for "lag" are used. The synthesis of singing voice sounds that able to accurately reproduce singing techniques having a tendency to change in a complex manner depending on the singing voice characteristics of the singer is implemented thereby. By fusing such techniques in the first embodiment of statistical voice synthesis processing, in which HMM acoustic models are employed, with real-time performance technology using the electronic keyboard instrument 100, for example, singing techniques and vocal qualities of a model singer that were not possible with a conventional electronic musical instrument employing concatenative synthesis or the like are able to be reflected accurately, and performances in which a singing voice sounds as if that singer were actually singing are able to be realized in concert with, for example, a keyboard performance on the electronic keyboard instrument 100.

In the second embodiment of statistical voice synthesis processing employing a DNN acoustic model described with reference to FIGS. 3 and 5, the decision tree based context-dependent HMM acoustic models in the first embodiment of statistical voice synthesis processing are replaced with a DNN. It is thereby possible to express relationships between linguistic feature sequences and acoustic feature sequences using complex non-linear transformation functions that are difficult to express in a decision tree. In decision tree based context-dependent HMM acoustic models, because corresponding training data is also classified based on decision trees, the training data allocated to each context-dependent HMM acoustic model is reduced. In contrast, training data is able to be efficiently utilized in a DNN acoustic model because all of the training data used to train a single DNN. Thus, with a DNN acoustic model it is possible to predict acoustic features with greater accuracy than with HMM acoustic models, and the naturalness of voice synthesis is able be greatly improved. In a DNN acoustic model, it is possible to use linguistic feature sequences relating to frames. In other words, in a DNN acoustic model, because correspondence between acoustic feature sequences and linguistic feature sequences is determined in advance, it is possible to utilize linguistic features relating to frames, such as "the number of consecutive frames for the current phoneme" and "the position of the current frame inside the phoneme". Such linguistic features are not easy taken into account in HMM acoustic models. Thus using linguistic feature relating to frames allows features to be modeled in more detail and makes it possible to improve the naturalness of voice synthesis. By fusing such techniques in the second embodiment of statistical voice synthesis processing, in which a DNN acoustic model is employed, with real-time performance technology using the electronic keyboard instrument 100, for example, singing voice performances based on a keyboard performance, for example, can be made to more naturally approximate the singing techniques and vocal qualities of a model singer.

In the embodiments described above, statistical voice synthesis processing techniques are employed as voice synthesis methods, can be implemented with markedly less memory capacity compared to conventional concatenative synthesis. For example, in an electronic musical instrument that uses concatenative synthesis, memory having several hundred megabytes of storage capacity is needed for voice sound fragment data. However, the present embodiments get by with memory having just a few megabytes of storage capacity in order to store training result 315 model parameters in FIG. 3. This makes it possible to provide a lower cost electronic musical instrument, and allows singing voice performance systems with high quality sound to be used by a wider range of users.

Moreover, in a conventional fragmentary data method, it takes a great deal of time (years) and effort to produce data for singing voice performances since fragmentary data needs to be adjusted by hand. However, because almost no data adjustment is necessary to produce training result 315 model parameters for the HMM acoustic models or the DNN acoustic model of the present embodiments, performance data can be produced with only a fraction of the time and effort. This also makes it possible to provide a lower cost electronic musical instrument. Further, using a server computer 300 available for use as a cloud service, or training functionality built into the voice synthesis LSI 205, general users can train the electronic musical instrument using their own voice, the voice of a family member, the voice of a famous person, or another voice, and have the electronic musical instrument give a singing voice performance using this voice for a model voice. In this case too, singing voice performances that are markedly more natural and have higher quality sound than hitherto are able to be realized with a lower cost electronic musical instrument.

In the embodiments described above, the present invention is embodied as an electronic keyboard instrument. However, the present invention can also be applied to electronic string instruments and other electronic musical instruments.

Voice synthesis methods able to be employed for the vocalization model unit 308 in FIG. 3 are not limited to cepstrum voice synthesis, and various voice synthesis methods, such as LSP voice synthesis, may be employed therefor.

In the embodiments described above, a first embodiment of statistical voice synthesis processing in which HMM acoustic models are employed and a second embodiment of a voice synthesis method in which a DNN acoustic model is employed were described. However, the present invention is not limited thereto. Any voice synthesis method using statistical voice synthesis processing may be employed by the present invention, such as, for example, an acoustic model that combines HMMs and a DNN.

In the embodiments described above, lyric information is given as musical piece data. However, text data obtained by voice recognition performed on content being sung in real time by a user may be given as lyric information in real time. The present invention is not limited to the embodiments described above, and various changes in implementation are possible without departing from the spirit of the present invention. Insofar as possible, the functionalities performed in the embodiments described above may be implemented in any suitable combination. Moreover, there are many aspects to the embodiments described above, and the invention may take on a variety of forms through the appropriate combination of the disclosed plurality of constituent elements. For example, if after omitting several constituent elements from out of all constituent elements disclosed in the embodiments the advantageous effect is still obtained, the configuration from which these constituent elements have been omitted may be considered to be one form of the invention.

It will be apparent to those skilled in the art that various modifications and variations can be made in the present invention without departing from the spirit or scope of the invention. Thus, it is intended that the present invention cover modifications and variations that come within the scope of the appended claims and their equivalents. In particular, it is explicitly contemplated that any part or whole of any two or more of the embodiments and their modifications described above can be combined and regarded within the scope of the present invention.

What is claimed is:

1. An electronic musical instrument, comprising:

an operation unit that specifies a pitch;

a memory that stores lyric data including lyrics for a plurality of timings, pitch data including pitches for said plurality of timings, and a trained model that has been trained and learned singing voice features of a singer based on training data including lyrics and pitches; and at least one processor, wherein at each of said plurality of timings, the at least one processor performs the following:

if the operation unit is not operated at the timing, obtaining, from the trained model, a singing voice feature of the singer that is associated with a lyric indicated by the lyric data for the timing and a pitch indicated by the pitch data for the timing;

if the operation unit is operated at the timing, obtaining, from the trained model, a singing voice feature of the singer that is associated with the lyric indicated by the lyric data for the timing and a pitch indicated by the operation of the operation unit at the timing; and synthesizing and outputting singing voice data based on the obtained singing voice feature of the singer.

2. The electronic musical instrument according to claim 1, wherein the singing voice data is outputted at a first tempo that has been set; and wherein if the first tempo is changed to a second tempo by a user operation, the singing voice data is outputted at the second tempo.

3. The electronic musical instrument according to claim 1, wherein said at least one processor outputs an accompaniment data by superimposing the accompaniment data on the singing voice data, wherein when a first tempo has been set, the accompaniment data and the singing voice data are outputted at the first tempo, and wherein when the first tempo is changed to a second tempo, the accompaniment data and the singing voice data are outputted at the second tempo.

4. The electronic musical instrument according to claim 1, wherein said at least one processor performs the following:

determining whether the operation unit is operated or not at each of said plurality of timings;

based on said determination, selecting either one of the pitch indicated by the operation of the operation unit or the pitch indicated by the pitch data;

inputting the selected pitch and the lyric indicated by the lyric data to the trained model to cause the trained model to output the singing voice feature of the singer in response to the inputted selected pitch and the inputted lyric; and synthesizing the singing voice data based on the singing voice feature.

5. The electronic musical instrument according to claim 1, wherein said at least one processor synthesizes inferred singing voice data that infers a singing voice of the singer based on the obtained singing voice feature of the singer, and outputs the synthesized inferred singing voice data even if a user does not sing.

6. An electronic musical instrument, comprising:

an operation unit that receives a user operation;

a memory that stores a trained model that has been trained and learned singing voice features of a singer based on training data including lyrics and pitches; and at least one processor, wherein the at least one processor performs the following:

in response to a first operation of the operation unit, obtaining, from the trained model, a singing voice feature of the singer that is associated with a lyric and a pitch indicated by the first operation of the operation unit;

synthesizing and outputting singing voice data based on the obtained singing voice feature of the singer; and if a second operation of the operation unit is performed during the first operation of the operation unit, applying an acoustic effect on the singing voice data.

7. The electronic musical instrument according to claim 6, wherein the memory further stores lyric data including lyrics for a plurality of timings, wherein the lyric data indicates said lyric with which the singing voice feature of the singer is associated, and wherein the second operation of the operation unit that triggers the acoustic effect on the singing voice data satisfies a prescribed condition relative to the first operation of the operation unit.

8. The electronic musical instrument according to claim 7, wherein the said at least one processor changes a depth of the acoustic effect on the singing voice data in accordance with a difference in pitch between the pitch indicated by the first operation of the operation unit and a pitch indicated by the second operation of the operation unit.

9. The electronic musical instrument according to claim 7, wherein the second operation of the operation unit that triggers the acoustic effect on the singing voice data is a repeated operation of an operation element of the operation unit during the first operation of the operation unit, and the acoustic effect is one of a vibrato effect, a tremolo effect, and a wah-wah effect that has been preselected.

10. A method of controlling an electronic musical instrument having an operation unit, comprising:

referring to lyric data including lyrics for a plurality of timings, pitch data including pitches for said plurality of timings, and a trained model that has been trained and learned singing voice features of a singer based on training data including lyrics and pitches;

at each of said plurality of timings, if the operation unit is not operated at the timing, obtaining, from the trained model, a singing voice feature of the singer that is associated with a lyric indicated by the lyric data for the timing and a pitch indicated by the pitch data for the timing, and if a first operation of the operation unit occurs at the timing, obtaining, from the trained model, a singing voice feature of the singer that is associated with the lyric indicated by the lyric data for the timing and a pitch indicated by the first operation of the operation unit at the timing; and synthesizing and outputting singing voice data based on the obtained singing voice feature of the singer.

11. The method according to claim 10, further comprising, if a second operation of the operation unit is performed during the first operation of the operation unit, applying an acoustic effect on the singing voice data.

12. The method according to claim 11, wherein the second operation of the operation unit that triggers the acoustic effect on the singing voice data satisfies a prescribed condition relative to the first operation of the operation unit.

13. The method according to claim 12, wherein a depth of the acoustic effect on the singing voice data is changed in accordance with a difference in pitch between the pitch indicated by the first operation of the operation unit and a pitch indicated by the second operation of the operation unit.

14. The method according to claim 12, wherein the second operation of the operation unit that triggers the acoustic effect on the singing voice data is a repeated operation of an operation element of the operation unit during the first operation of the operation unit, and the acoustic effect is one of a vibrato effect, a tremolo effect, and a wah-wah effect that has been preselected.

15. The method according to claim 10, wherein the singing voice data is outputted at a first tempo that has been set, and wherein if the first tempo is changed to a second tempo by a user operation, the singing voice data is outputted at the second tempo.

16. The method according to claim 10, further comprising outputting an accompaniment data by superimposing the accompaniment data on the singing voice data, wherein when a first tempo has been set, the accompaniment data and the singing voice data are outputted at the first tempo, and wherein when the first tempo is changed to a second tempo, the accompaniment data and the singing voice data are outputted at the second tempo.

17. The method according to claim 10, further comprising synthesizing inferred singing voice data that infers a singing voice of the singer based on the obtained singing voice feature of the singer, and outputting the synthesized inferred singing voice data even if a user does not sing.

* * * * *